US006237167B1

(12) United States Patent
Hunden

(10) Patent No.: US 6,237,167 B1
(45) Date of Patent: May 29, 2001

(54) HEIGHT-ADJUSTABLE SHOWER ARC

(76) Inventor: Walter E. Hunden, 5801 Mt. Murphy Rd., Garden Valley, CA (US) 95633

( * ) Notice: Subject to any disclaimer, the term of this patent is extended or adjusted under 35 U.S.C. 154(b) by 0 days.

(21) Appl. No.: 09/447,801

(22) Filed: Nov. 23, 1999

Related U.S. Application Data

(60) Provisional application No. 60/117,237, filed on Jan. 26, 1999.

(51) Int. Cl.[7] ..... A47K 3/20
(52) U.S. Cl. ..... 4/567; 4/615
(58) Field of Search ..... 4/567–570, 601, 4/615

(56) References Cited

U.S. PATENT DOCUMENTS

| | | | | |
|---|---|---|---|---|
| 380,011 | | 5/1888 | Smith . | |
| 1,188,681 | * | 6/1916 | Rosenberg | 4/567 |
| 1,501,762 | | 7/1924 | Ferguson . | |
| 1,758,767 | | 5/1930 | Taggart . | |
| 1,986,355 | * | 1/1935 | Pajari | 4/570 |
| 2,829,379 | | 4/1958 | McGee . | |
| 3,170,171 | | 2/1965 | Mayhew et al. . | |
| 4,142,257 | | 3/1979 | Mace . | |
| 4,724,553 | | 2/1988 | Bianchi . | |
| 4,749,130 | | 6/1988 | Utzinger . | |
| 4,865,254 | | 9/1989 | Kragle . | |
| 5,418,985 | | 5/1995 | Antoine . | |

FOREIGN PATENT DOCUMENTS

| | | | | |
|---|---|---|---|---|
| 0497290 | * | 12/1950 | (BE) | 4/615 |
| 6-284985 | | 10/1994 | (JP) . | |
| 1806719 A1 | | 4/1993 | (SU) . | |

* cited by examiner

*Primary Examiner*—Charles E. Phillips

(57) ABSTRACT

The shower apparatus of the present invention has an arcuate pipe dimensioned to substantially encircle a person taking a shower. The arcuate pipe has perforations that allow water supplied to the pipe to be discharged onto the body of the person taking a shower. The arcuate pipe is pivotally attached to a carrier which is slidably movable along a vertical guide plate. The carrier has a clamping feature that allows the vertical position of the arcuate pipe to be fixed at a height selected by a user. The shower apparatus of the present invention can be retrofitted to existing shower fixtures.

19 Claims, 18 Drawing Sheets

HEIGHT-ADJUSTABLE SHOWER ARC

CROSS-REFERENCE TO RELATED APPLICATION

This application claims the benefit of U.S. Provisional Patent Application Serial No. 60/117,237, filed Jan. 26, 1999.

BACKGROUND OF THE INVENTION

1. Field of the Invention

The present invention relates to a shower system that allows water to be directed to a user's body without getting the user's head wet.

2. Description of Related Art

Many people have their hair professionally styled by a hair stylist at great expense. These people generally visit the hair stylist once a week to maintain the look and hairstyle that they desire. During the visits to the hair stylist their hair is shampooed and styled. To maintain their hair style in between visits to the hairstylist, such people must avoid getting their hair wet.

Heretofore, shower caps have been used to prevent the wetting of styled hair while the person takes a shower; however, shower caps suffer from several drawbacks. First, the perspiration trapped by the shower cap is often sufficient to cause the hair to get wet resulting in a matted, flattened look to the hair. Second, the mechanical impact of bunching the hair under the shower cap and of the force applied to the hair by the shower cap and its elastic gather, tend to flatten the hair or otherwise ruin the hair style. Therefore, it would be desirable to provide an appliance that allows people to take showers without getting their hair wet.

Many unconventional shower appliances for directing the flow of water to various body parts in a more controlled fashion have been proposed in the art. Examples of such shower appliances are provided herein below.

U.S. Pat. No. 382,011, issued to Benjamin C. Smith on May 1, 1888, shows a shower appliance including an arcuate, horizontal, perforated pipe having vertical, perforated pipes branching therefrom.

U.S. Pat. No. 1,501,762, issued to Robert G. Ferguson on Jul. 15, 1924, shows a shower appliance having a circular, perforated pipe which can be hydraulically raised or lowered. The height adjustment range of the appliance in Ferguson is very limited.

U.S. Pat. No. 1,758,767, issued to Louis E. Taggart on May 13, 1930, shows a shower appliance having a circular, perforated pipe which is pivoted down to place the circular pipe around a body and pivoted up to remove the circular pipe from around the body.

U.S. Pat. No. 2,829,379, issued to Robert M. McGee on Apr. 8, 1958, shows a bathing apparatus having a circular, perforated pipe which is placed on the ground and sprinkles water on a person sitting at the center of the circular pipe.

U.S. Pat. No. 3,170,171, issued to Lawrence E. Mayhew et al. on Feb. 23, 1965, shows a shower hoop for amusement purposes which includes a perforated pipe formed into an upright shower hoop. The upright shower hoop sprinkles water on people jumping through the hoop.

U.S. Pat. No. 4,142,257, issued to Allen R. Mace on Mar. 6, 1979, shows a pair of circular shower hoops that are height adjustable. The shower hoops are attached to a carrier which has internal passages for supplying water and other additives, such as soap or perfumes, to the shower hoops.

Pairs of side-by-side rollers held between a pair of elongated channels having C-shaped cross sections, allow the assembly including the shower hoops and the carrier to be moved vertically. The carrier has clamping means for fixing the location of the shower hoops at a desired height. The shower hoops of Mace do not pivot. Further, Mace does not disclose a carrier or guide rail having the same structural features as the carrier and guide rail of the present invention. In addition, Mace fails to disclose any details of the structure of the clamping means used as part of the apparatus shown in the Mace patent.

U.S. Pat. No. 4,724,553, issued to Remigio Bianchi on Feb. 16, 1988, shows an apparatus for providing a hydromassage over the whole body of a person. The apparatus of Bianchi includes helical perforated pipe portions that rotate about an axis coincident with the axis of the person's body to thereby cause water to impinge upon the person's entire body.

U.S. Pat. No. 4,749,130, issued to Gustav E. Utzinger on Jun. 7, 1988, shows an apparatus for spraying water on a person. The apparatus of Utzinger includes a helically wound perforated pipe which sprays water upon a person surrounded by the helically wound perforated pipe.

U.S. Pat. No. 4,865,254, issued to George D. Kragle on Sep. 12, 1989, shows a two headed shower consisting of Y-shaped conduit having an inlet and a shower head at each of its two outlets.

U.S. Pat. No. 5,418,985, issued to Robert Antoine on May 30, 1995, shows a horizontal shower hoop attached to a carrier. The carrier is vertically movable and is guided by a T-shaped rail engaged by rollers mounted to the carrier. A cable attached to the carrier is taken up around a motorized, rotating cam to pull the carrier along the rail in accordance with a predetermined program. The shower hoop of Antoine does not pivot. Further, Antoine does not disclose a carrier or guide rail having the same structural features as the carrier and guide rail of the present invention. In addition, Antoine does not disclose a clamping means such as that used as part of the present invention.

Soviet Document Number 1806719, dated Apr. 7, 1993, shows an apparatus having a series of vertically arranged arcuate shower pipes which spray water on a person's body. Japanese Document Number 6,284,985, dated Oct. 11, 1994, shows a plurality of shower nozzles arranged in an arc to shower water upon a seated person.

None of the above inventions and patents, taken either singly or in combination, is seen to describe the instant invention as claimed. In particular, none of the above inventions and patents teach or suggest a pivoting shower arc adapted to move vertically. Further, none of the above inventions and patents teach or suggest a carrier or guide rail having the same structural features as the carrier and guide rail of the present invention.

SUMMARY OF THE INVENTION

The present invention is directed to a shower apparatus having an arcuate pipe dimensioned to substantially encircle a person taking a shower. The arcuate pipe has perforations that allow water supplied to the pipe to be discharged onto the body of the person taking a shower. The arcuate pipe is pivotally attached to a carrier which is slidably movable along a vertical guide plate. The carrier has a clamping feature that allows the vertical position of the arcuate pipe to be fixed at a height selected by a user. The shower apparatus of the present invention can be retrofitted to existing shower fixtures.

Accordingly, it is a principal object of the invention to provide a shower apparatus that can shower a person's body with water without getting the person's head wet.

It is another object of the invention to provide a shower apparatus having a perforated, arcuate pipe which substantially encircles the person taking a shower as liquid is discharged on to the person's body.

It is a further object of the invention to provide a shower apparatus which is adjustable in height to suit users of different heights.

Still another object of the invention is to provide a shower apparatus which can be retrofitted to existing shower fixtures.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
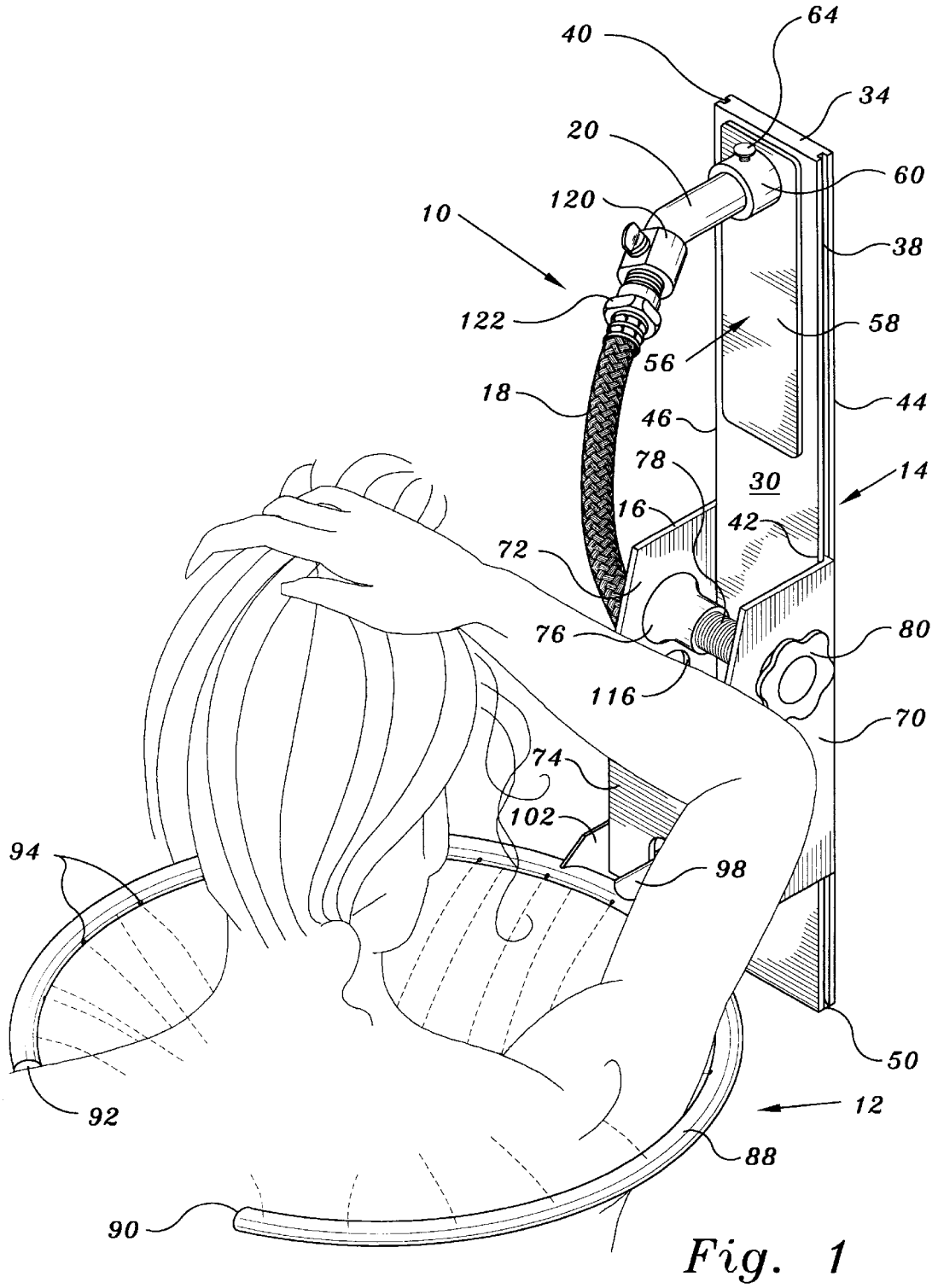
FIG. 1 is an environmental view showing a person using the height-adjustable shower arc according to the present invention.
Figure 2:
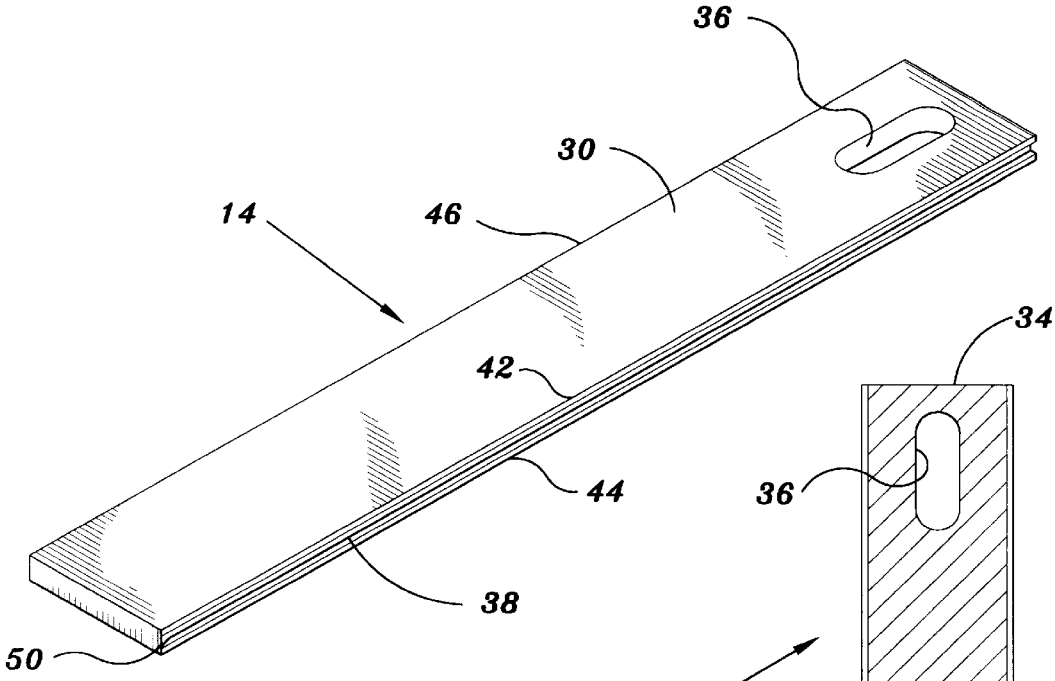
FIG. 2 is a perspective view of the guide plate of the height-adjustable shower arc according to the present invention.
Figure 3:
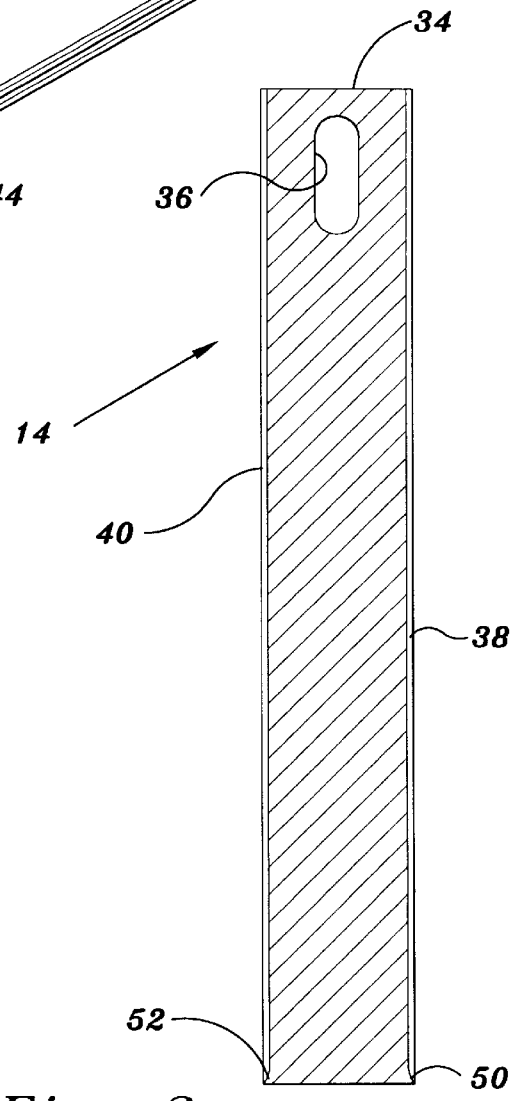
FIG. 3 is a cross sectional view of the guide plate of the height-adjustable shower arc according to the present invention.

Referring to FIGS. 1–14, the present invention is directed to a height-adjustable shower arc 10, also variously referred to herein as the shower apparatus or the shower appliance 10. The shower appliance 10 includes four major components, these being the shower arc 12, the guide plate 14, the shower arc carrier 16, and the water supply hose 18. In a typical shower there is a shower head supply pipe 20 which projects from the wall 22 of the shower. The pipe 20 projects from the wall 22 above a tub 24 (see FIGS. 15 and 16). The pipe 20 is usually located above the bottom of the tub 24 at about the height of an average person. The pipe 20 usually projects horizontally from the wall 22. The pipe 20 is usually bent such that the pipe's threaded end 26, located distally from the wall 22, points downward at an angle from the horizontal. A conventional shower head 28 is normally threadedly attached to the distal end 26 of the pipe 20 (see FIGS. 15 and 16). The shower head 28 is designed to spread the water stream over a wide area so as to efficiently wet the body of a person taking a shower.

The guide plate 14 is substantially rectangular and has a width and a length, the length being significantly longer than the width. Most preferably, the guide plate 14 is at least several times longer than it is wide. The guide plate 14 has a front face 30 and a back face 32 which is identical to the front face 30 except that the back face 32 faces in the opposite direction as compared to the front face 30. The front face 30 is so designated because in the illustrated example the face 30 faces away from the wall 22. The back face 32 is so designated because in the illustrated example the face 32 faces toward the wall 22. The faces 30 and 32 being identical, the guide plate 14 is reversible and can be mounted on the pipe 20 with either the face 30 or the face 32 facing the wall 22.

The faces 30 and 32 are parallel and spaced apart, and the perimeters of the faces 30 and 32 are superimposed on one another. The dimension extending between the faces 30 and 32 is the thickness of the guide plate 14. Near the top surface 34 of the guide plate 14 is an elongated oval hole 36 dimensioned to allow the pipe 20 to pass through the guide plate 14.

Lateral grooves 38 and 40 extend for substantially the entire length of the guide plate 14 on either side of the guide plate 14. The grooves 38 and 40 are formed in the thickness of the guide plate 14, intermediate the faces 30 and 32, with the depth of each groove extending parallel to the faces 30 and 32. The groove 38 opens to a plane defined by and extending between the lengthwise edges 42 and 44 of the faces 30 and 32, respectively. Similarly, the groove 40 opens to a plane defined by and extending between the lengthwise edges 46 and 48 of the faces 30 and 32, respectively.

The ends of the grooves 38 and 40 at which the grooves 38 and 40 intersect the top surface 34 of the guide plate 14, are open. The ends of the grooves 38 and 40 at or near the bottom of the guide plate 14, are obstructed by blockages 50 and 52 in order to prevent the carrier 16 from accidentally sliding off the bottom of the guide plate 14. The blockages 50 and 52 are formed by the material of the guide plate 14 filling the grooves 38 and 40 at or near the bottom of the guide plate 14.

To mount the guide plate 14 to the pipe 20, the shower head 28 is first removed from the pipe 20. Also, any decorative face plate covering the hole in the wall 22 through which the pipe 20 passes, such as face plate 54 shown in FIGS. 15 and 16 and, is removed.

The pipe 20 is then placed through the hole 36, and the guide plate 14 is allowed to hang vertically down from the horizontal portion of the pipe 20 and is then pushed against the wall 22 such that the back surface 32 abuttingly contacts the wall 22.

Figure 4:
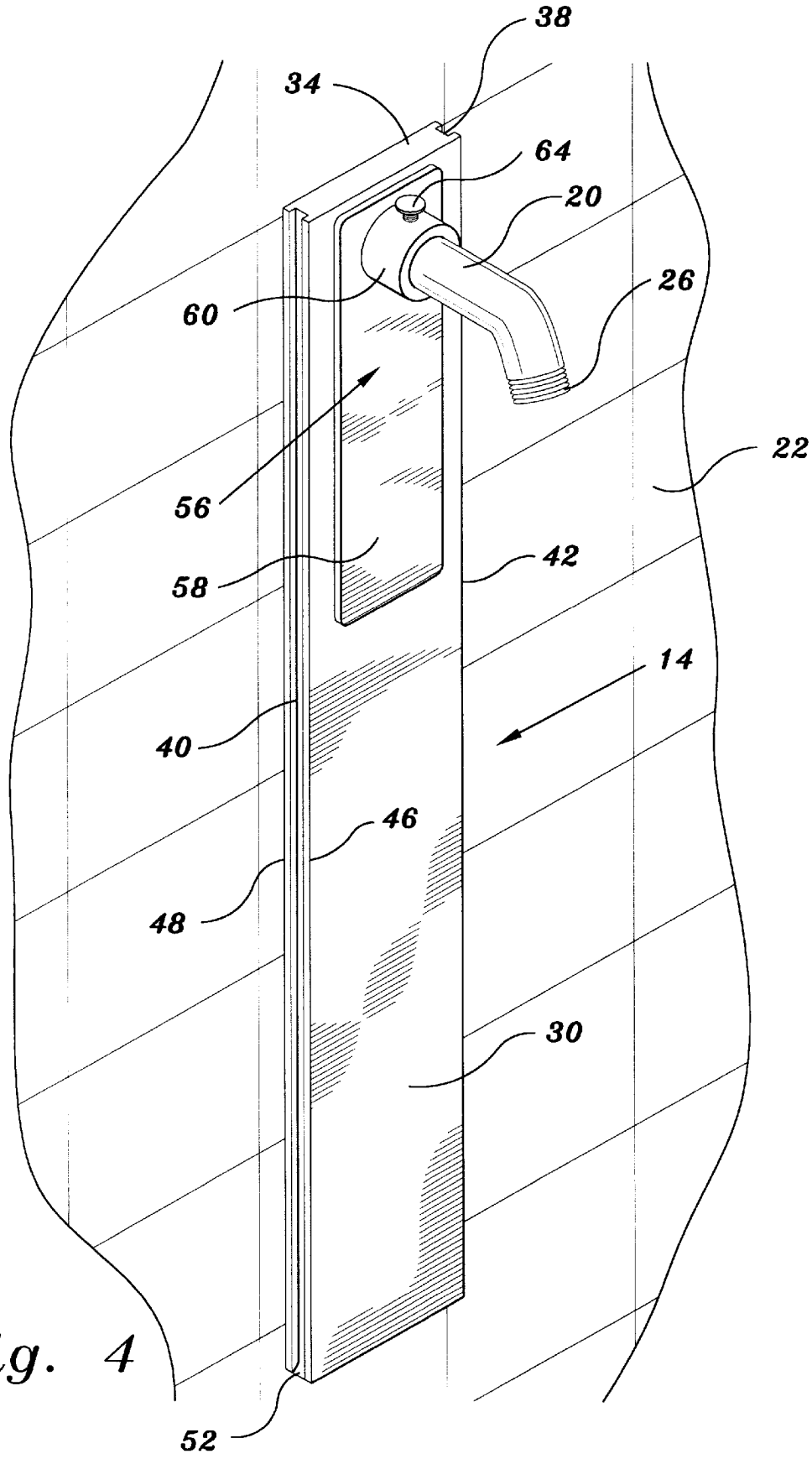
FIG. 4 is an environmental view of the guide plate of the height-adjustable shower arc according to the present invention.
Figure 5:
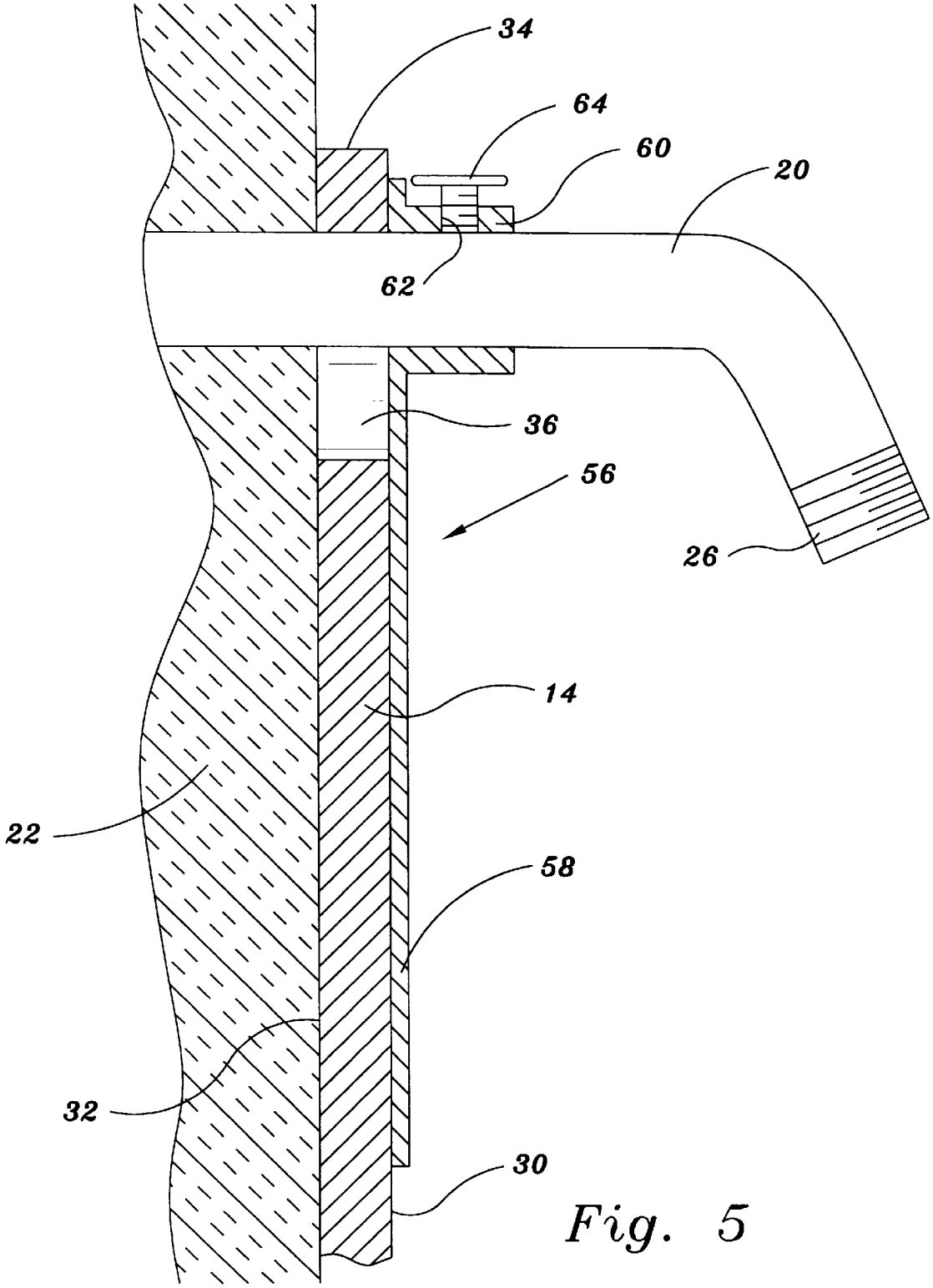
FIG. 5 is a cross sectional view showing the guide plate, of the height-adjustable shower arc according to the present invention, mounted to a water supply pipe of a conventional shower head.

Referring to FIGS. 4 and 5, the guide plate 14 is held in place by a retaining plate 56. The retaining plate 56 has a plate portion 58 which presses against the guide plate 14. Near the top of the plate portion 58 there is a hole which is dimensioned to fit around the pipe 20. A collar 60 is attached to the plate portion 58 about the hole near the top of the plate portion. The collar 60 has a bore that is coextensive with the hole around which the collar is attached. A threaded hole 62 traverses the thickness of the wall of the collar 60 and communicates with the bore of the collar 60. A set screw 64 is threadedly engaged to the hole 62 and can be turned to position a portion of the set screw in the bore of the collar 60. The set screw 64 has a head or knob which is knurled, lobed, bladed, faceted, or otherwise shaped to allow the set screw 64 to be grasped and turned by hand. With the guide plate 14 mounted on the pipe 20, the retaining plate 56 positioned on the pipe 20 such that the pipe 20 passes through the collar 60 and the guide plate 14 is sandwiched between the retaining plate 56 and the wall 22. The set screw 64 is then tightened until the set screw 64 frictionally engages the pipe 20 to clamp the retaining plate 56 to the pipe 20 and thus hold the guide plate 14 in place.

Figure 6:
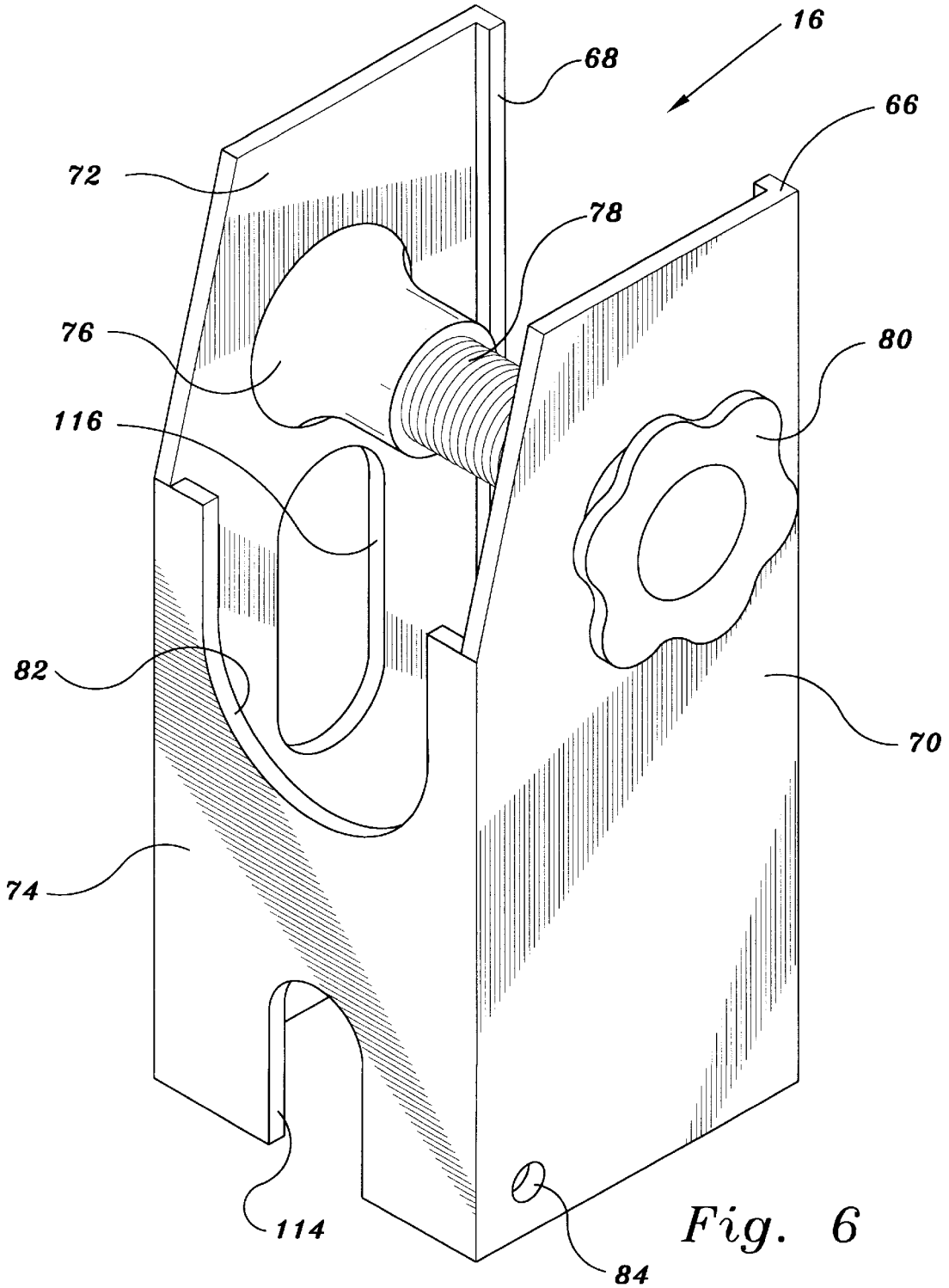
FIG. 6 is a perspective view of the shower arc carrier used as part of the height-adjustable shower arc according to the present invention.
Figure 7:
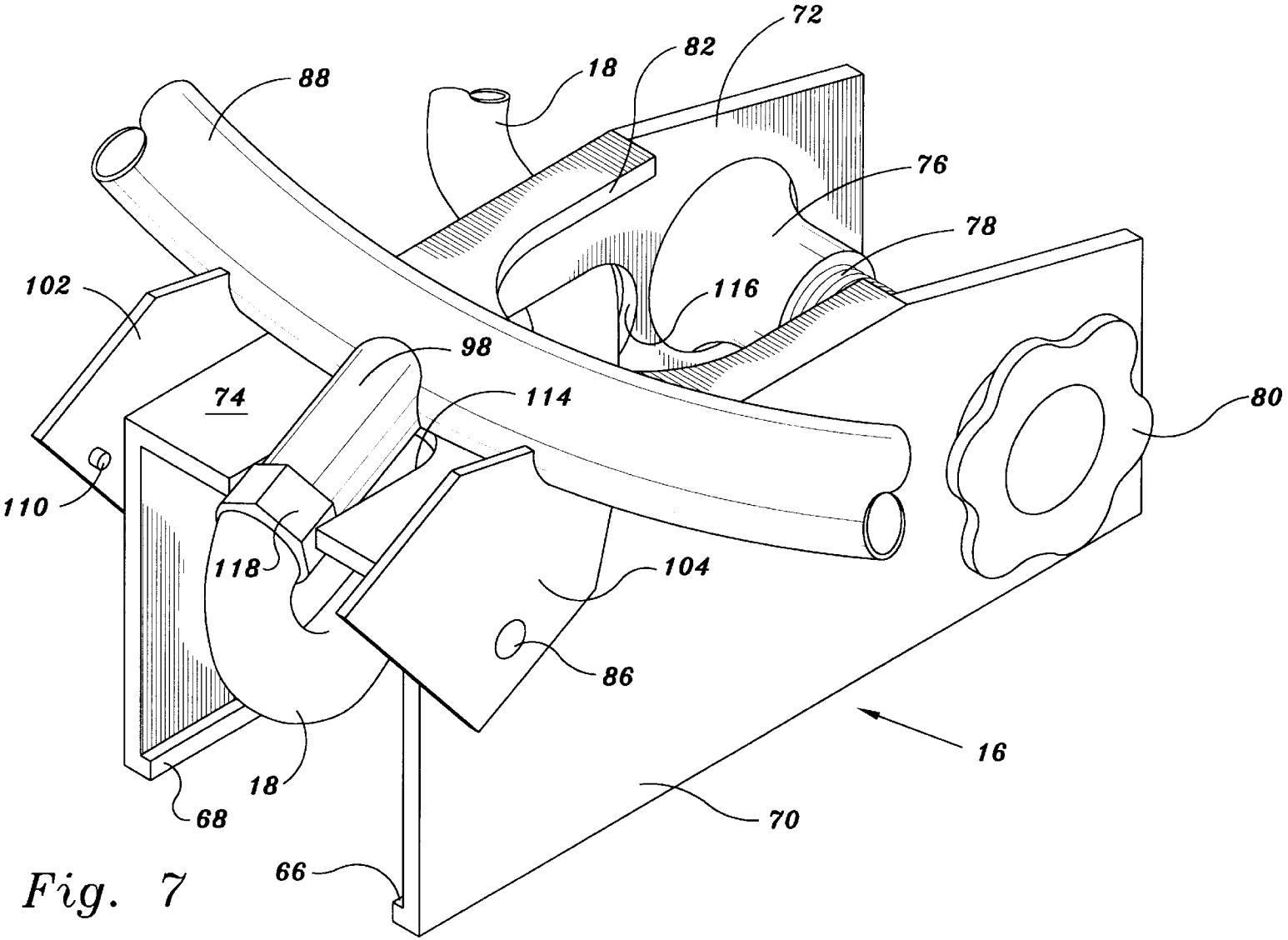
FIG. 7 is a bottom perspective view of the shower arc and carrier according to the present invention, showing the attachment of the water hose to the shower arc.
Figure 8:
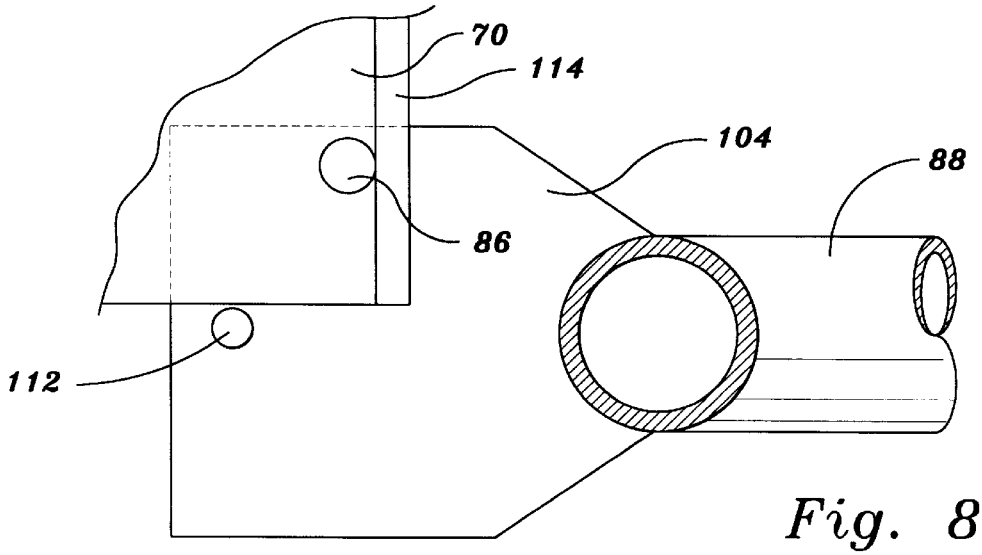
FIG. 8 is a fragmentary view showing details of the pivotal attachment of the shower arc to the carrier.
Figure 9:
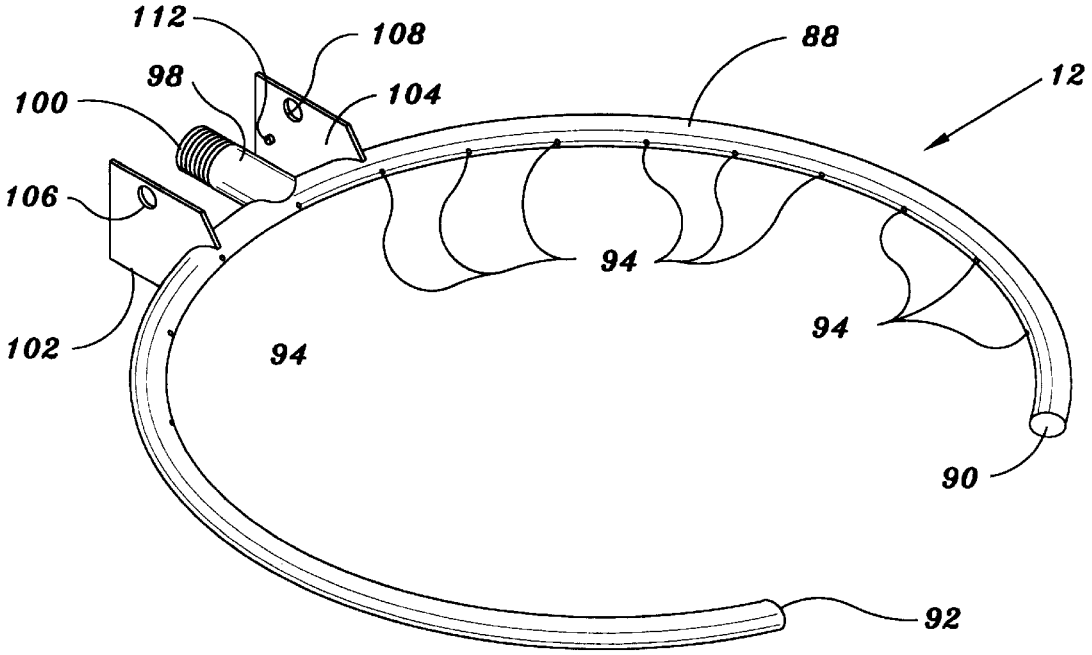
FIG. 9 is a perspective view showing the shower arc according to the present invention in isolation.
Figure 10:
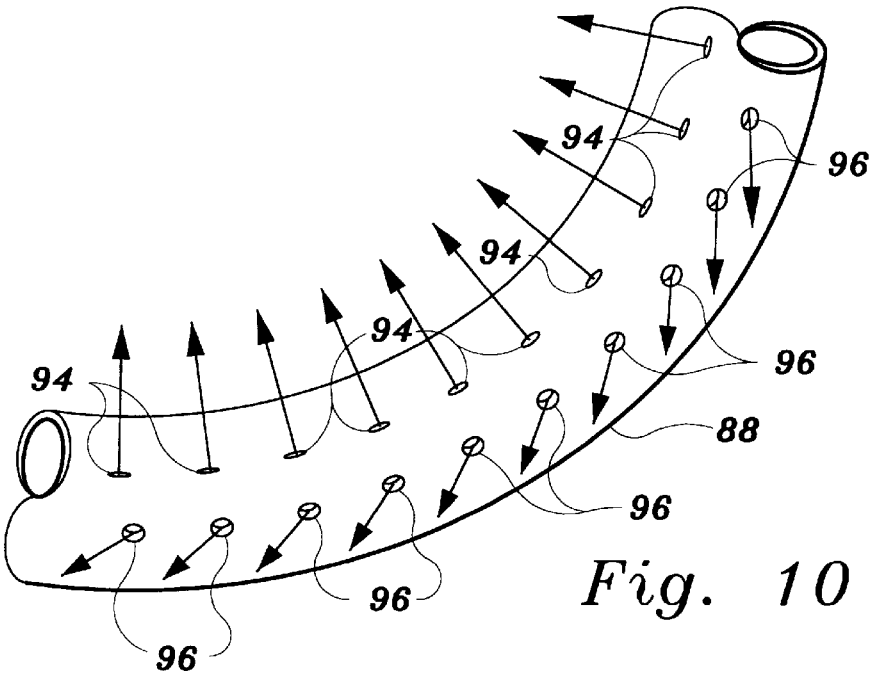
FIG. 10 is a fragmentary view showing a portion of the perforated arcuate pipe forming the shower arc according to the present invention.
Figure 11:
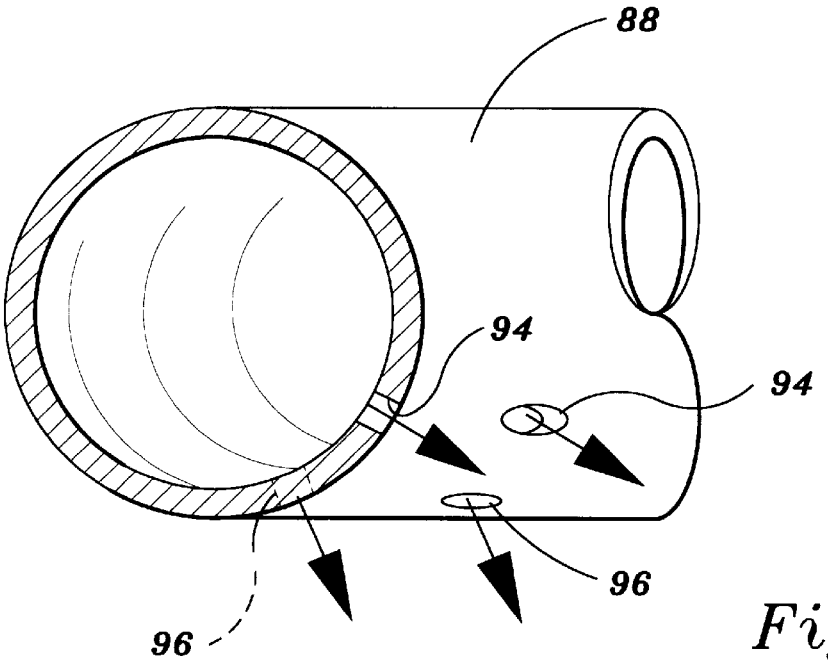
FIG. 11 is a fragmentary view showing the angles of the perforations in the perforated, arcuate pipe forming the shower arc according to the present invention.

Referring to FIG. 6, the shower arc carrier 16 has a pair of ribs 66 and 68 which are dimensioned to fit into and be slidably movable along the grooves 38 and 40, respectively. The ribs 66 and 68 project perpendicularly from side plates 70 and 72, respectively. Side plates 70 and 72 are parallel to one another and have profiles that are superimposed on one another when the carrier 16 is viewed from either side. When installed, the side plates 70 and 72 project perpendicularly relative to the wall 22 and the front face 30 of the guide plate 14, in a direction away from the wall 22 on either side of the guide plate 14. The ribs 66 and 68 are formed along the edges of the side plates 70 and 72, respectively, which are proximate to the wall 22 and the guide plate 14. A front plate 74 is fixedly attached to the side plates 70 and 72, and extends from the distal edge of the side plate 70 to the distal edge of the side plate 72, the distal edges of the side plates 70 and 72 being the edges farthest from the guide plate 14 in the fully assembled shower appliance 10. The front plate 74 spans the distance between the distal edges of the side plates 70 and 72 over only a portion of the vertical extent of the side plates 70 and 72, to thereby give greater flexibility to the carrier 16 and allow relative movement between the side plates 70 and 72. Thus, when the shower appliance 10 is fully assembled, the side plates 70 and 72 straddle the width of the guide plate 14 with the ribs 66 and 68 positioned in the grooves 38 and 40, respectively. Normally, the carrier 16 would be engaged to the guide plate 14 before the guide plate 14 is mounted to the pipe 20, otherwise the pipe 20 may interfere with the sliding of the ribs 66 and 68 into the grooves 38 and 40 from the top of the guide plate 14.

The surface of the side plate 72 which faces the side plate 70, has a protuberance 76 projecting therefrom. In the illustrated embodiment, the protuberance 76 is substantially cylindrical and projects perpendicularly from the side plate 72 toward the side plate 70. The attachment of the protuberance 76 to the side plate 72 may have a fillet or a weld which causes the protuberance 76 to deviate from a perfect cylinder. The protuberance 76 has a central bore or cavity which is threaded to matingly receive the threaded shaft of a screw 78.

The shaft of the screw 78 passes through a hole in the side plate 70 which is large enough for the shaft of the screw 78 to pass through, but the hole through which the shaft of the screw 78 passes is too small for the screw head 80 to pass therethrough. Screw head 80 is in the form of a knob which is suitable for grasping and turning by hand. The screw head or knob 80 can be knurled, lobed, bladed, faceted, grooved, or otherwise shaped to allow the knob 80 to be grasped and turned by hand. With the threaded shaft of the screw 78 passing through the hole in the side plate 70 and matingly engaging the threaded bore of the protuberance 76, turning the knob 80 to tighten the screw 78 will cause the side plates 72 and 70 to be brought together. Thus when the screw 78 is sufficiently tightened, the carrier 16 will be clamped to the guide plate 14 to thereby fix the carrier 16, and the shower arc 12, at the desired height. If the shaft of the screw 78 is long enough it can directly engage a threaded hole in the side plate 72 without the need for the protuberance 76. Also, any support structure that can fixedly support a threaded bore relative to the side plate 72, even with the threaded bore extending for a very short distance, can be substituted for the cylindrical protuberance 76 without affecting the function of the carrier 16.

The carrier 16 in its relaxed state is dimensioned such that the fit of the ribs 66 and 68 into the grooves 38 and 40 is loose enough for the carrier 16 to be slidably movable along the guide plate 14. When the screw 78 is sufficiently tightened, the side plates 70 and 72 are forced together thereby clamping the carrier 16 to the guide plate 14. The material of the carrier 16, which can be aluminum, stainless steel, brass, or plastic, is inherently resilient enough such that when the screw 78 is loosened the side plates 70 and 72 return to their original positions relative to one another, and the carrier 16 can once again slide freely along the guide plate 14. The screw 78 can then once again be tightened to fixedly position the carrier 16 and the shower arc 12 at any desired height.

As was previously stated, the carrier 16 needs to be sufficiently flexible to allow the side plates 70 and 72 to resiliently move relative to one another. If necessary, a U-shaped cutout 82 may be formed in the front plate 74 to provide added flexibility to the carrier 16.

Located proximate the bottom of each of the side plates 70 and 72 is a hole 84 (only one shown) for receiving a respective one of a pair of pivot shafts 86 (only one shown). Only one of the holes 84 and only one of the pivot shafts 86 are shown, because each hole 84 and its respective pivot shaft 86 are mirror images of the other hole 84 and its associated pivot shaft 86.

Referring to FIGS. 1, 7–10, the shower arc 12 is formed in part by a perforated, arcuate pipe 88. The arcuate pipe 88 extends along a circular arc and has first and second ends 90 and 92 which are spaced apart from one another to form a C-shaped arcuate pipe. The pipe 88 is closed at its ends 90 and 92 and has two sets of perforations 94 and 96 along its length. When the shower arc 12 is unfolded such that the arc along which the pipe 88 extends lies essentially in a horizontal plane, each of the first set of perforations 94 is oriented to discharge water substantially horizontally or at a slight angle below the horizontal and, in plan view, toward the center of the arc along which pipe 88 extends. Again with the pipe 88 in the horizontal position, each of the second set of perforations 96 discharges water downward at a greater angle from the horizontal as compared to the first set of holes 94. In addition, when the pipe 88 is in the horizontal position, the perforations 96 discharge water toward a vertical line passing through the center of curvature, of the arc along which the pipe 88 extends. For example, each of the second set of perforations 96 may be oriented so as to discharge water downward at about a 45° angle relative to the horizontal, toward a vertical line passing through the center of curvature of the arcuate pipe 88. Preferably, with the shower arc 12 positioned at just above a person's shoulders, the holes 94 will discharge water toward the person's shoulders and upper torso, while the holes 96 will discharge water toward the person's lower chest or waist. Both sets of holes 94 and 96 are evenly distributed along the length of the pipe 88 with one hole 96 being positioned intermediate each pair of holes 94 in plan view. Each of the holes 94 and 96 is spaced about an inch apart from its nearest neighbor, i.e. each hole 94 is spaced two inches apart from each adjacent hole 94 and each hole 96 is spaced two inches apart from each adjacent hole 96. The gap between the first and second ends 90 and 92 allows a person taking a shower to exit the shower area without having to lower his or her head and shoulders or having to raise the shower arc 12.

Projecting from the middle of the pipe 88, in a direction radially away from the center of curvature of the pipe 88, is a short length of pipe 98. The pipe 98 forms the inlet to the arcuate pipe 88, the bore of the pipe 98 being in fluid communication with the arcuate pipe 88. The end 100 of the inlet pipe 98, located distally from the arcuate pipe 88, is open and is threaded externally to allow attachment of the hose 18.

A pair of pivot plates 102 and 104 are attached to the arcuate pipe 88 on either side of the inlet pipe 98. The pivot plates 102 and 104 extend parallel to the inlet pipe 98 away from the center of curvature of the arcuate pipe 88. The pivot plates 102 and 104 are spaced apart such that the carrier 16 fits snugly between the pivot plates 102 and 104, with the side walls 70 and 72 parallel to the pivot plates 102 and 104. Each of the pivot plates 102 and 104 has a hole 106 and 108, respectively. With the pivot plates 102 and 104 positioned on either side of the carrier 16, each of the holes 106 and 108 registers with a respective one of the holes 84. Each of the pivot shafts 86 is then positioned to extend through a respective hole 84 and a respective one of the holes 106 and 108 to pivotally attach the shower arc 12 to the carrier 16. The pivot shafts 86 are shown schematically in the attached illustrations and can be of any well known type. For example, each pivot shaft 86 can be a pin press fitted to either its respective hole 84 or the respective one of the holes 106 and 108. Preferably, the pivot shafts 86 are a pair of bolts, each being positioned to extend through a respective hole 84 and a respective one of the holes 106 and 108 and secured in place by a respective nut. The bolts acting as pivot shafts 86 should be tightened enough such that there is sufficient frictional force between the pivot plate 102 and the side plate 72 and between the pivot plate 104 and the side plate 70 so that the shower arc 12 will stay up after it has been folded up into the retracted or storage position.

Proximate the bottom edge of the pivot plate 102 there is a cylindrical projection 110 which projects toward the pivot plate 104. The projection 110 is located behind the center of pivot of the respective pivot shaft 86 of the pivot plate 102, and the projection 110 abuts the bottom edge of the side plate 72 when the shower arc 12 is in the horizontal position. Similarly, proximate the bottom edge of the pivot plate 104 there is a cylindrical projection 112 which projects toward the pivot plate 102. The projection 112 is located behind the center of pivot of the respective pivot shaft 86 of the pivot plate 104, and the projection 112 abuts the bottom edge of the side plate 70 when the shower arc 12 is in the horizontal position. The projections 110 and 112 act as stops which prevent the shower arc 12 from pivoting downward past the horizontal position. Another U-shaped cutout 114 formed in the front plate 74 provides clearance for the inlet pipe 98 so that the shower arc 12 can pivot without interference from the front plate 74 of the carrier 16.

The hose 18 is routed through an elongated oval hole 116 formed in the side plate 72. A hole similar to hole 116 may be provided in the side plate 70 to give the user the option of routing the hose 18 through either one of the side plates 70 or 72.

Figure 12:
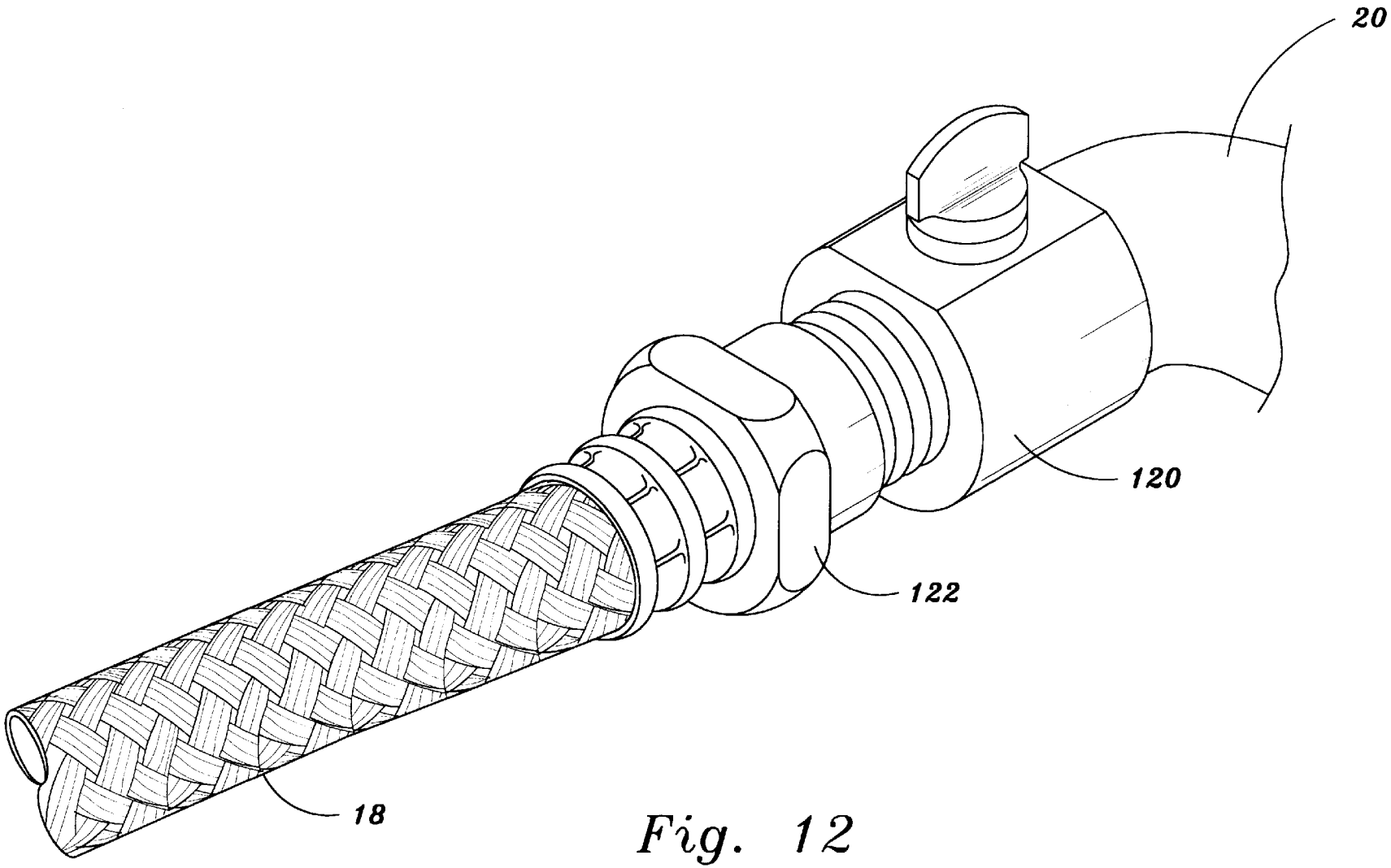
FIG. 12 is a fragmentary view showing details of the attachment, to the shower head water supply pipe, of the water hose supplying water to the shower arc made in accordance with the present invention.
Figure 13:
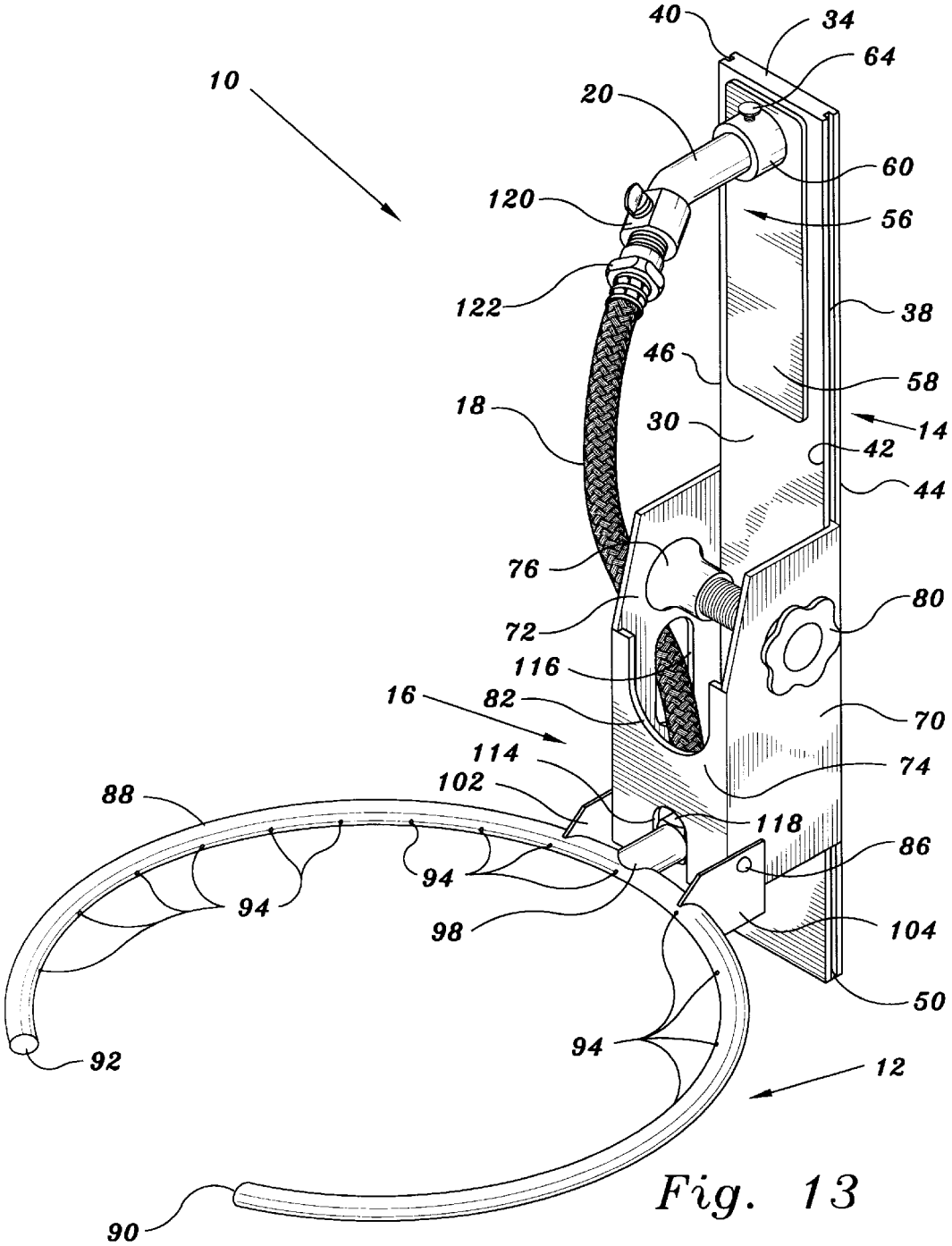
FIG. 13 is a perspective view of the height-adjustable shower arc according to the present invention showing the shower arc in the extended position.
Figure 14:
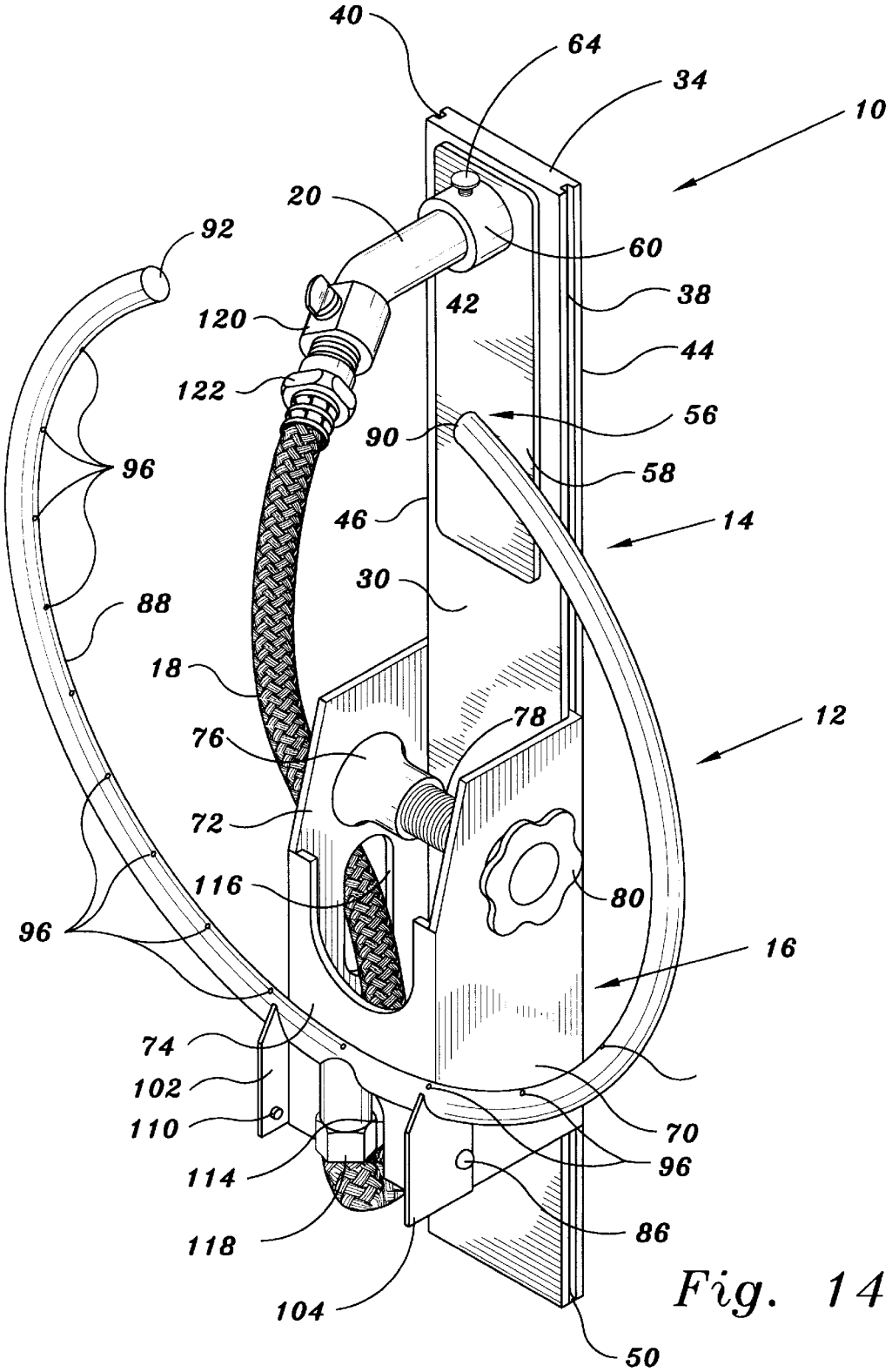
FIG. 14 is a perspective view of the height-adjustable shower arc according to the present invention showing the shower arc in the retracted or folded position.

A threaded collar 118 couples one end of the hose 18 to the threaded end of the inlet pipe 98 in a watertight manner. As shown in FIG. 12, the other end of the hose 18 is coupled to an on/off valve 120 by the threaded collar 122, also in a watertight manner. The on/off valve 120 is threadedly coupled to the threaded distal end 26 of the shower head supply pipe 20, again in a watertight manner. Thus, a watertight fluid conducting circuit is created between the shower head supply pipe 20 and the shower arc 12. With the hot and cold valves (not shown) normally supplying water to the shower head opened to supply water in the normal manner and at the desired temperature to the pipe 20, the on/off valve 120 is used to control the discharge of water from the shower arc 12. With the on/off valve 120 in place, once the hot and cold valves are opened to supply water at the desired temperature, the water flow through the shower arc 12 can be turned on and off without having to readjust the water temperature. The coupling between the hose 18 and the inlet pipe 98 and the coupling between the hose 18 and the on/off valve 120 are made using well known, standard plumbing fittings and techniques and will not be described herein in detail. Further, the on/off valve 120 is a well known, standard plumbing fixture and will also not be described herein in detail.

Figure 15:
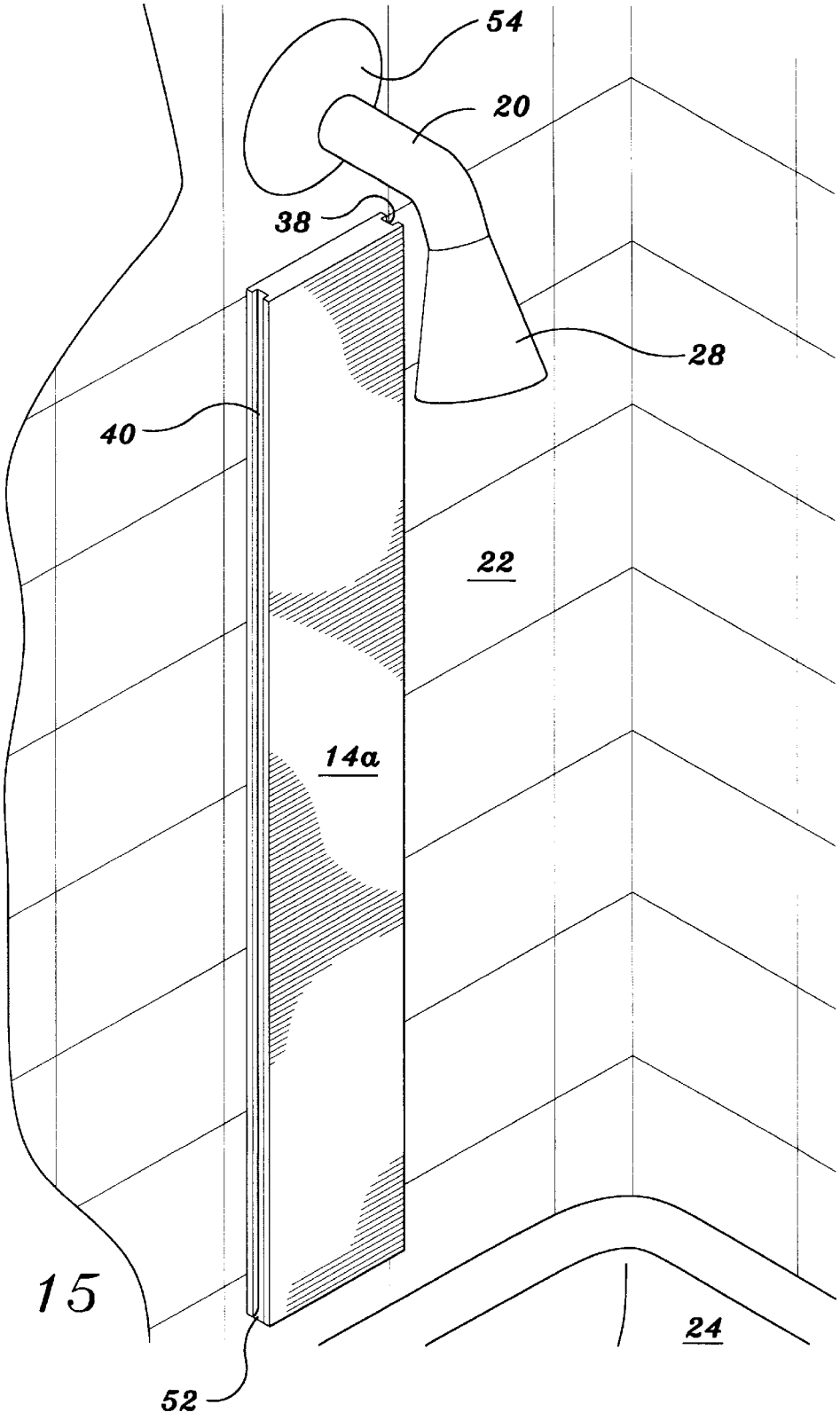
FIG. 15 is an environmental view showing an alternative type of guide plate, which attaches directly to the shower wall, for use with the height-adjustable shower arc according to the present invention.
Figure 16:
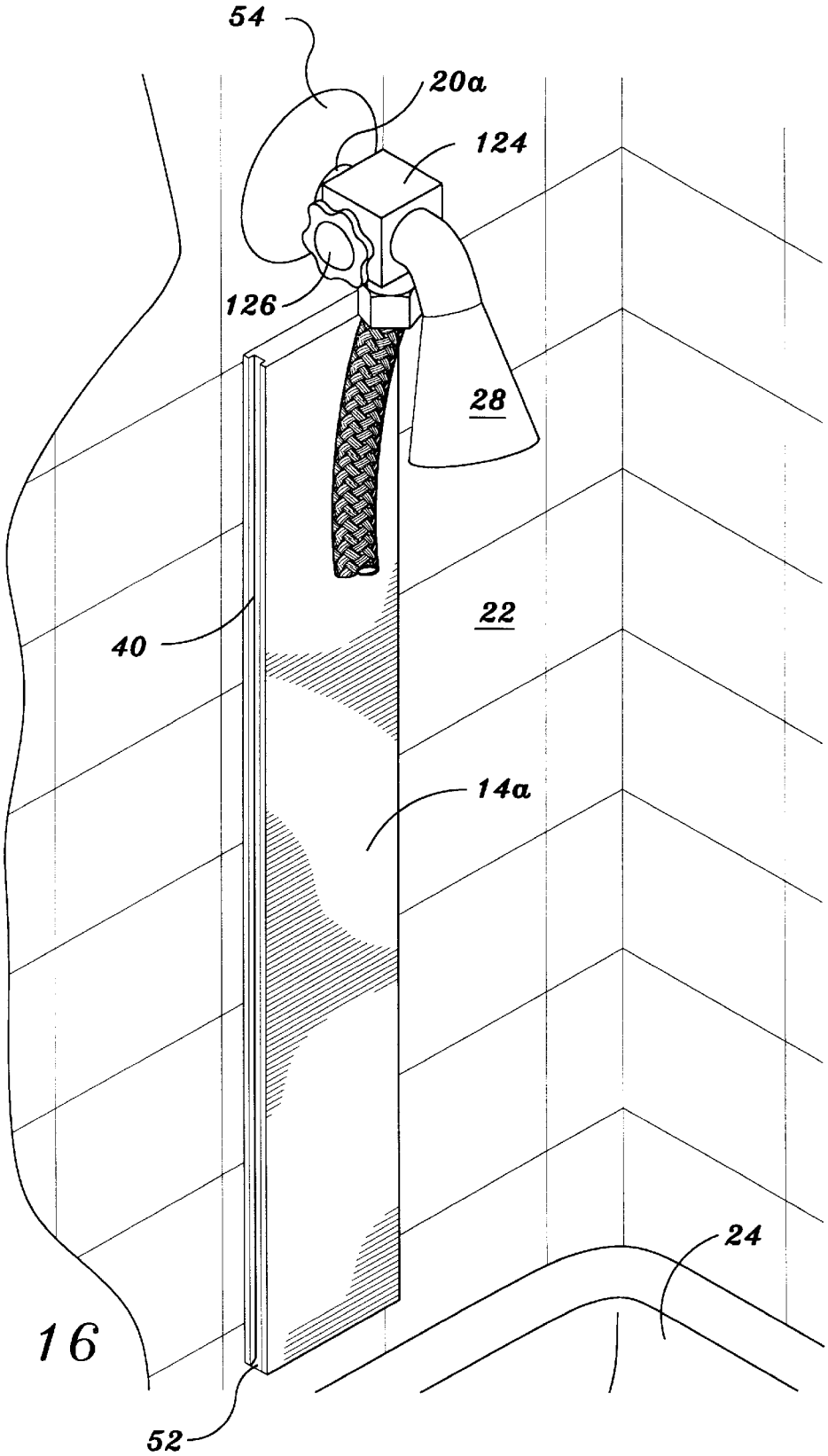
FIG. 16 is an environmental fragmentary view showing a three-way valve which allows the use of a conventional shower head in conjunction with the height-adjustable shower arc according to the present invention.
Figure 17:
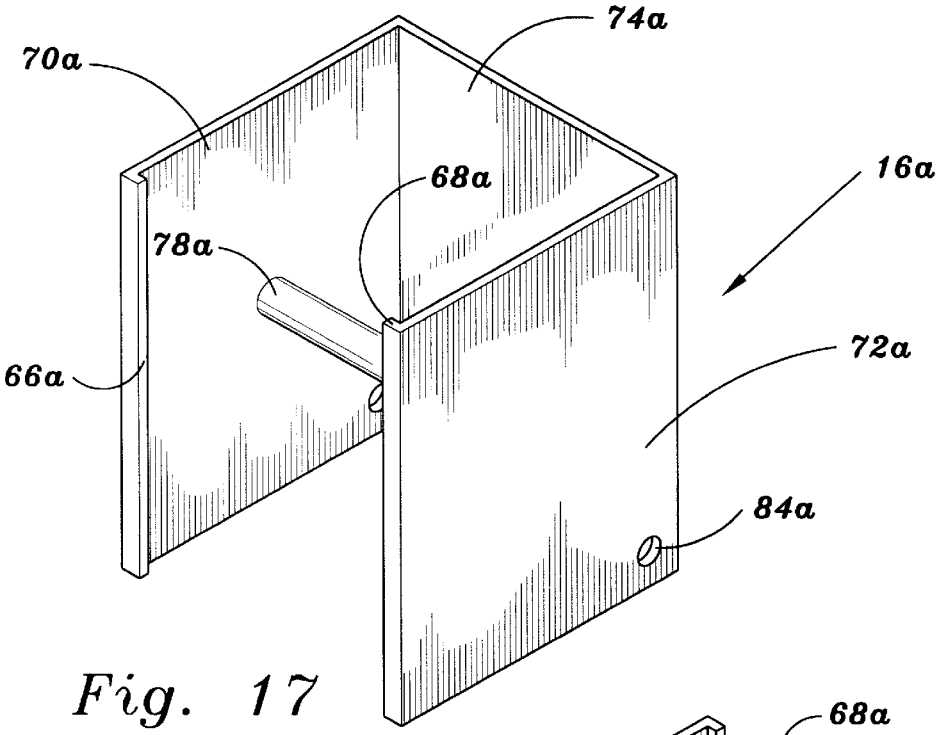
FIG. 17 is a rear perspective view of the second embodiment of the circular shower bar carrier according to the present invention.
Figure 18:
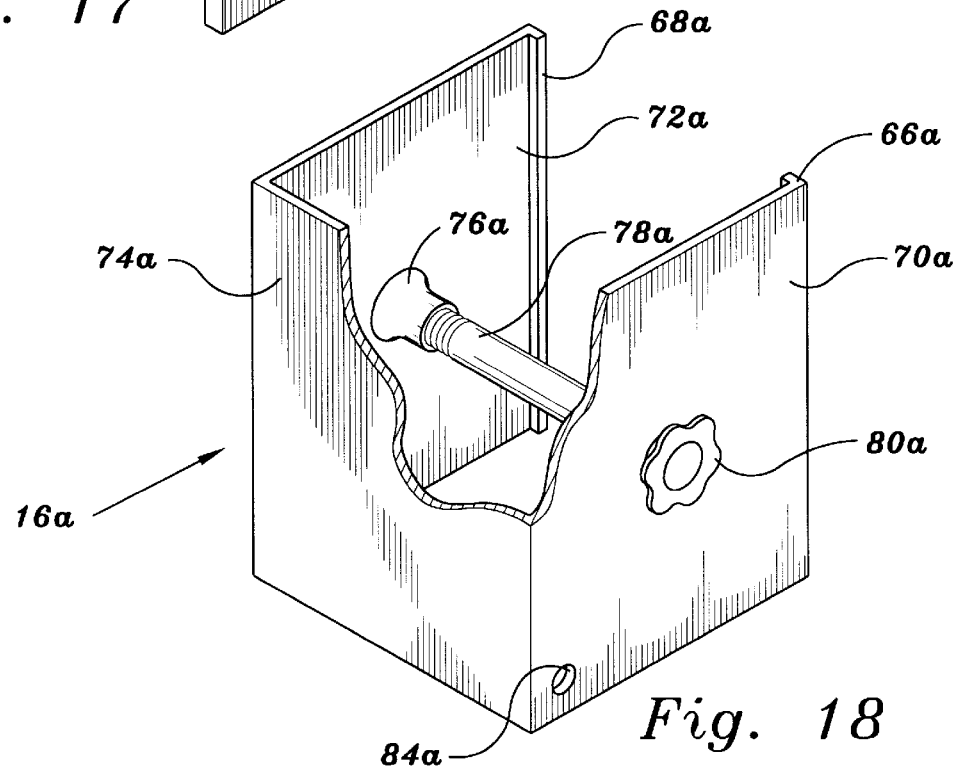
FIG. 18 is a front perspective view of the second embodiment of the circular shower bar carrier according to the present invention.
Figure 19A:
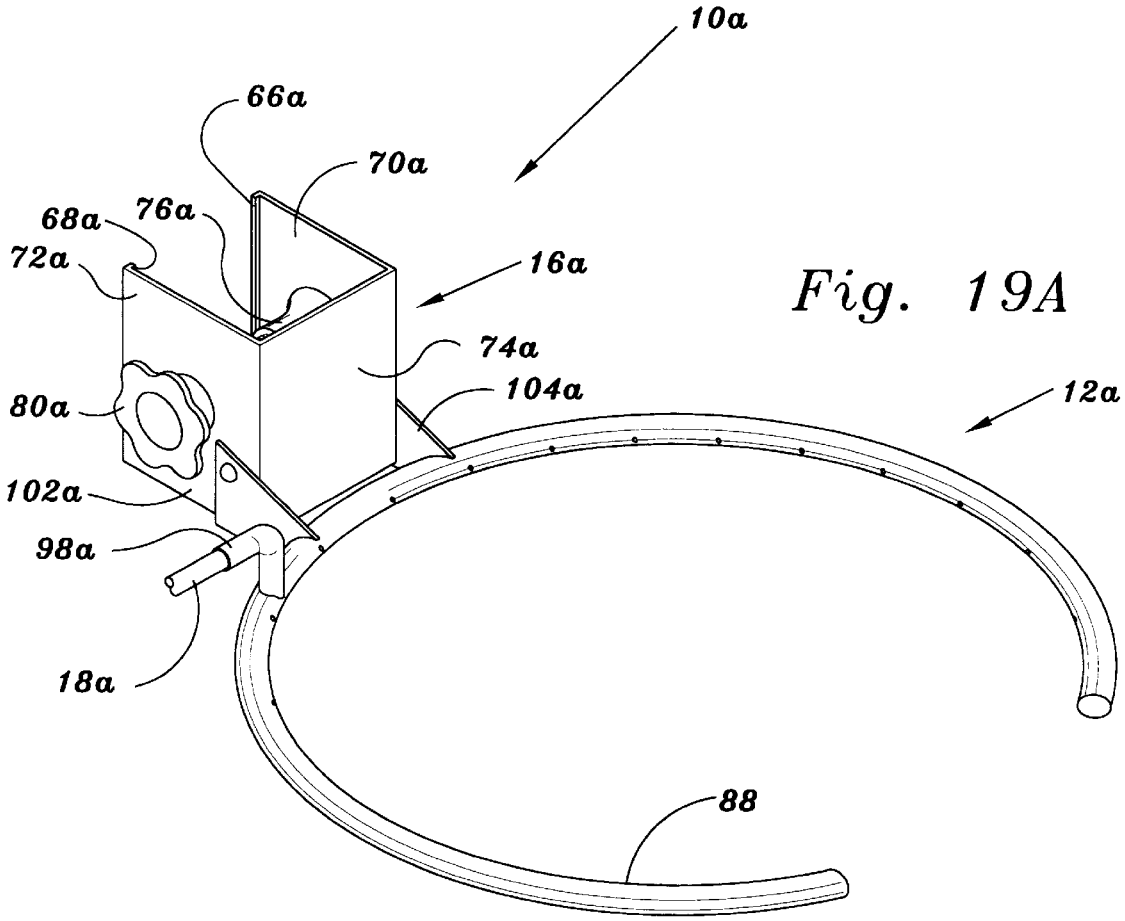
FIG. 19A is a perspective view showing the second embodiment of the shower arc and the shower arc carrier of the present invention with the shower arc in the down position.
Figure 19B:
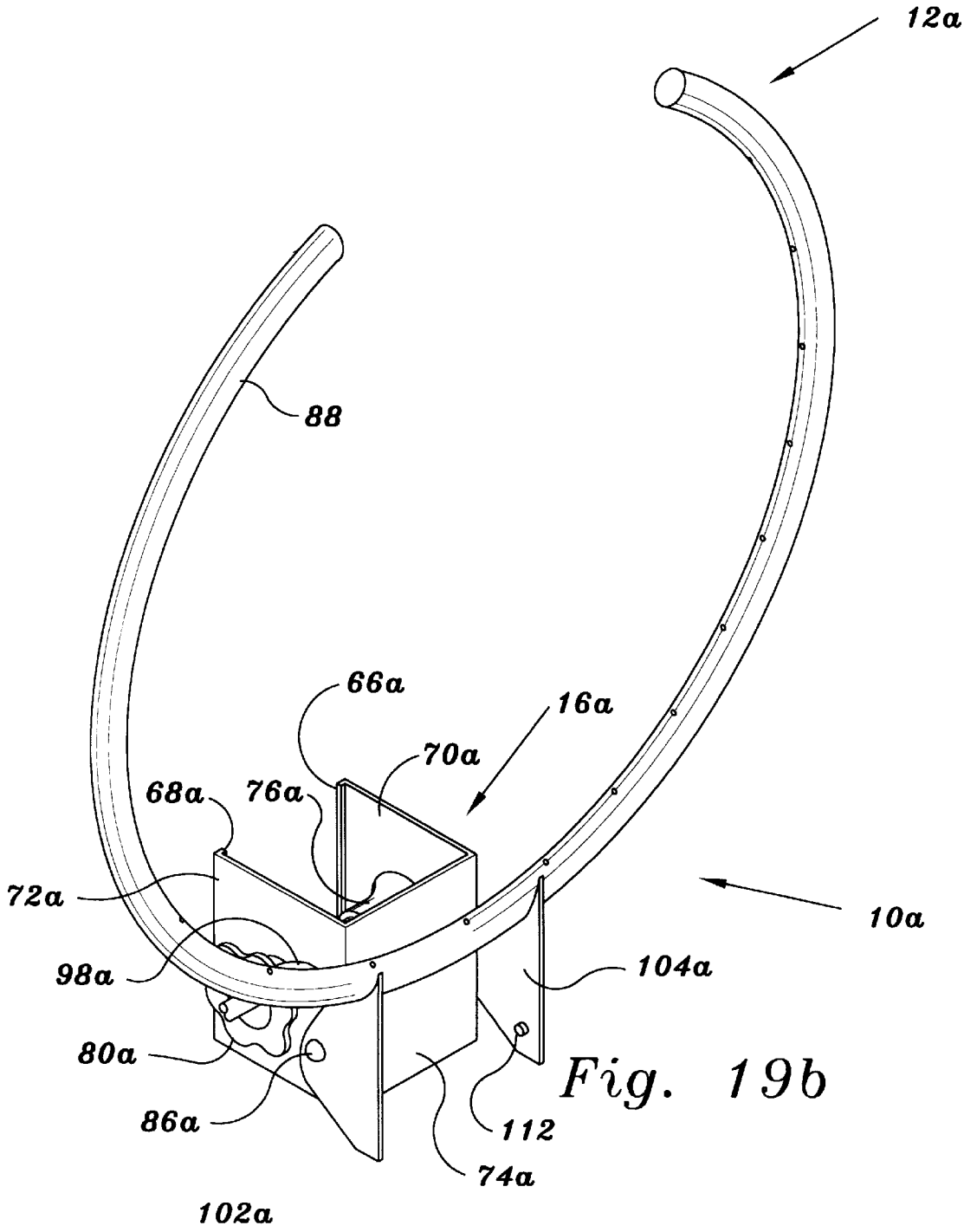
FIG. 19B is a perspective view showing the second embodiment of the shower arc and the shower arc carrier of the present invention with the shower arc in the up position.
Figures 20, 21:
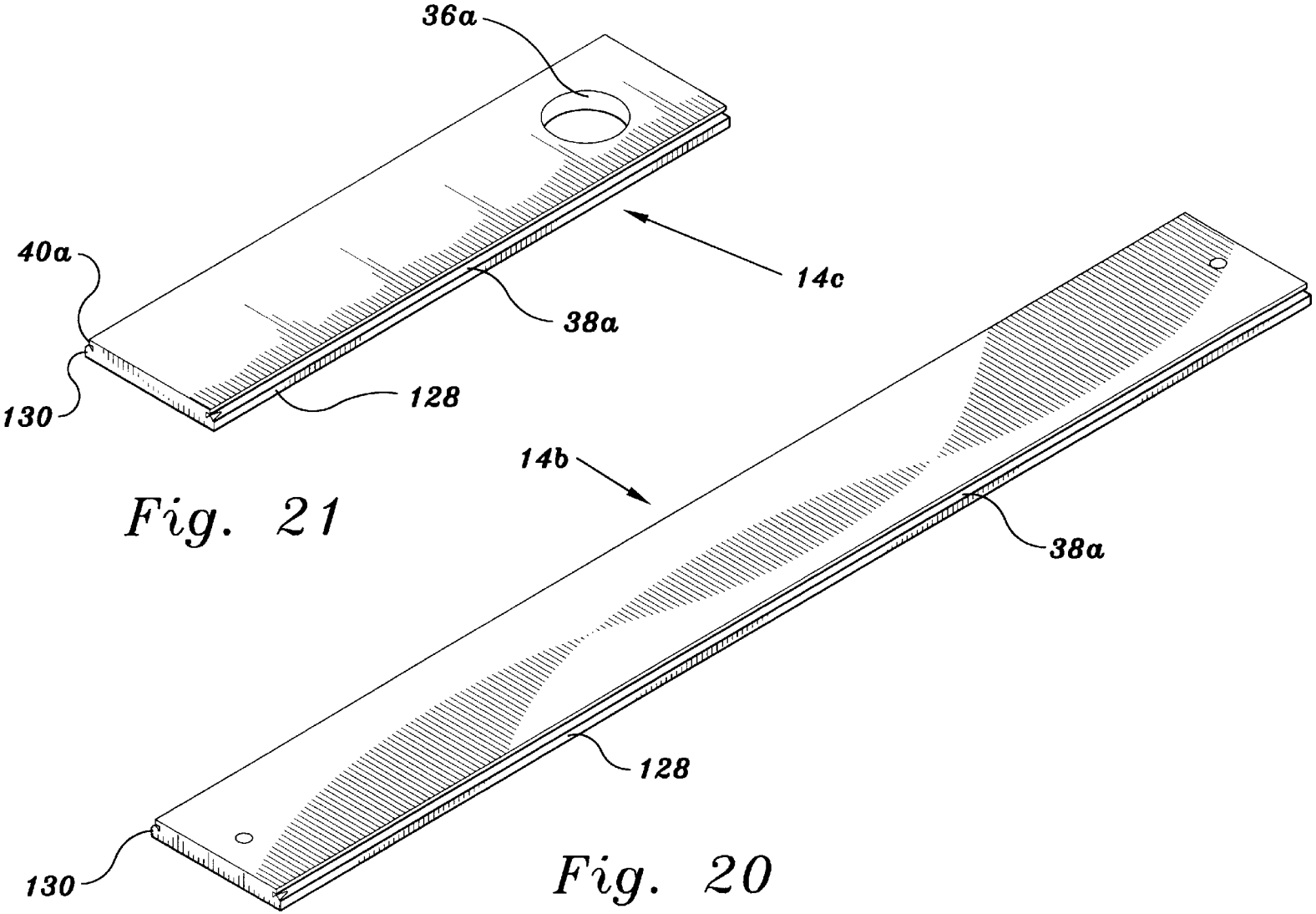
FIG. 20 is a perspective view showing the third embodiment of the guide plate used to slidably support the shower arc carrier of the present invention.
FIG. 21 is a perspective view showing the fourth embodiment of the guide plate used to slidably support the shower arc carrier of the present invention.
Figure 22A:
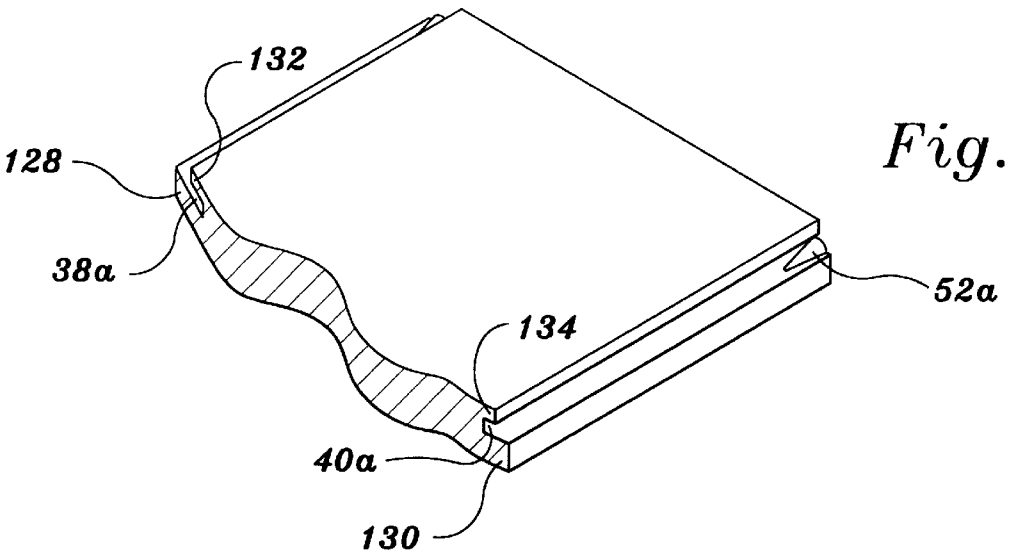
FIG. 22A is a top fragmentary perspective view showing details of an alternative form of the grooves at either side of the guide plate according to the present invention.
Figure 22B:
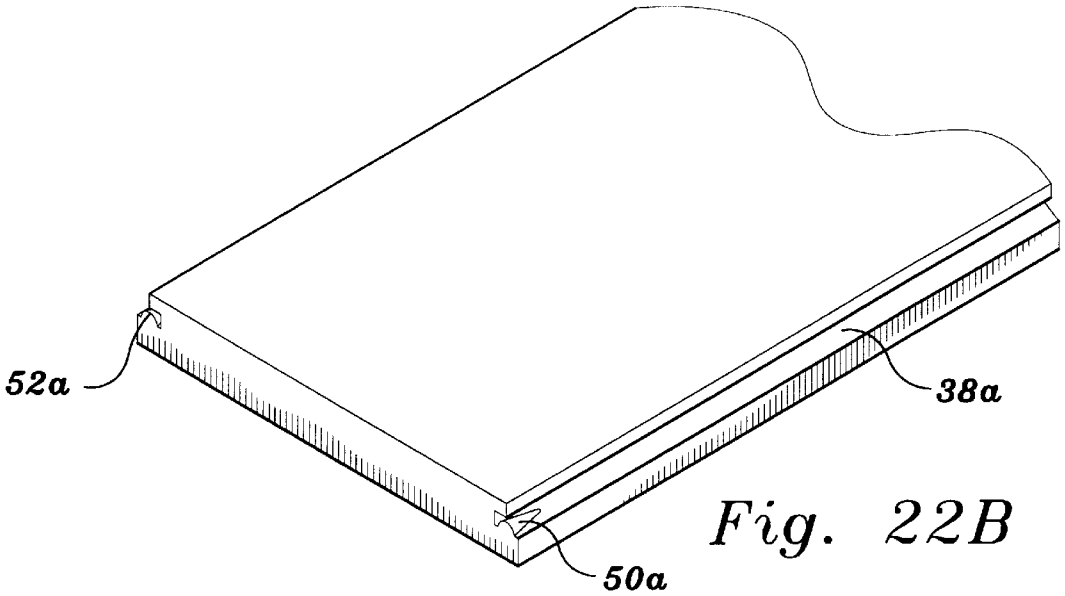
FIG. 22B is a bottom fragmentary perspective view showing details of an alternative form of the grooves at either side of the guide plate according to the present invention.

Referring to FIGS. 15 and 16, an alternative guide plate 14*a* can be seen. Guide plate 14*a* is intended for direct attachment to the shower wall 22. Guide plate 14*a* may be attached to the wall 22 in any well known manner including, but not limited to, using adhesives, using bolts or screws, using masonry anchors, and providing welded structures at the back of the guide plate 14*a* that can be embedded in mortar. Caulking or silicon rubber sealant can be used to seal gaps around the guide plate 14*a*. Except for the absence of the hole 36 and modifications necessary for direct attachment to the wall 22, the guide plates 14*a* and 14 are identical.

Referring to FIG. 16, a three-way valve 124 can be used in place of the on/off valve 120 to allow users the option of using either the shower arc 12 or the conventional shower head 28. The three-way valve 124 has an inlet and two outlets. The inlet of the three-way valve 124 is connected by a watertight coupling to a shortened shower head supply pipe 20*a*. Then one outlet of the three-way valve 124 is connected by a watertight coupling to the conventional shower head 28, while the second outlet of the three-way valve is connected by a watertight coupling to the end of the hose 18 distal from the threaded end of the shower arc inlet pipe 98. The three-way valve 124 has a knob 126 which has three settings. The first setting of the three-way valve 124 completely stops water flow through the three-way valve 124. The second setting of the three-way valve 124 allows water flow to the shower arc 12, while the third setting of the three-way valve 124 allows water flow to the shower head 28. Thus, at the option of the user either the shower arc 12 or the conventional shower head 28 can be used. Alternatively, a Y-shaped pipe such as that described in U.S. Pat. No. 4,865,254, incorporated herein by reference, can be used in place of the pipe 20. An on/off valve such as on/off valve 120 can be provided at each outlet of the Y-shaped pipe. The shower head 28 would be connected to one on/off valve, while the shower arc 12 would be connected, via the hose 18, to the other on/off valve. This arrangement would allow independent control of the water flow through the shower head 28 and the shower arc 12, and this arrangement would allow simultaneous use of the shower head 28 and the shower arc 12 at the option of the user. The watertight couplings and the three-way valve 124 are well known, standard plumbing fittings and fixtures and will not be described herein in detail.

Referring to FIGS. 17, 18, 19A, and 19B, a simplified embodiment of the height-adjustable shower arc 10*a* can be seen. The shower appliance 10*a* includes a shower arc 12*a*, a shower arc carrier 16*a*, and the water supply hose 18*a*. The carrier 16*a* can be mounted to any of the guide plates 14 and 14*a* in the same manner as the carrier 16.

The shower arc carrier 16*a* has a pair of ribs 66*a* and 68*a* which are dimensioned to fit into and be slidably movable along the grooves 38 and 40, respectively. The ribs 66*a* and 68*a* project perpendicularly from side plates 70*a* and 72*a*, respectively. Side plates 70*a* and 72*a* are parallel to one another and have simple rectangular profiles. A front plate 74*a* is fixedly attached to the side plates 70 and 72, and extends from the distal edge of the side plate 70*a* to the distal edge of the side plate 72*a*, the distal edges of the side plates 70*a* and 72*a* being the edges farthest from the guide plate 14 or 14*a* in the fully assembled shower appliance 10*a*. The ribs 66*a* and 68*a* are formed along the edges of the side plates 70*a* and 72*a*, respectively, which are proximate to the guide plates 14 or 14*a* in the fully assembled shower appliance 10*a*. Thus, when the shower appliance 10*a* is fully assembled, the side plates 70*a* and 72*a* straddle the width of the guide plate 14 or 14*a* with the ribs 66*a* and 68*a* positioned in the grooves 38 and 40, respectively.

A protuberance 76*a* projects from one of the side plates 70*a* and 72*a* toward the other of the side plates 70*a* and 72*a*. The protuberance 76*a* has a threaded bore which is threaded to matingly receive the threaded shaft of a screw 78*a*. The shaft of the screw 78*a* passes through a hole formed in the side plate 70*a* or 72*a* which does not have the protuberance 76*a*. The hole through which the shaft of the screw 78*a* passes is large enough for the shaft of the screw 78*a* to pass through, but the hole through which the shaft of the screw 78*a* passes is too small for the screw head 80*a* to pass therethrough. Screw head 80*a* is in the form of a knob which is suitable for grasping and turning by hand. With the threaded shaft of the screw 78*a* passing through the hole in one of the side plates 70 and 72*a* and matingly engaging the threaded bore of the protuberance 76*a*, turning the knob 80*a* to tighten the screw 78*a* will cause the side plates 72*a* and 70*a* to be brought together. Thus when the screw 78*a* is sufficiently tightened, the carrier 16*a* will be clamped to the guide plate 14 or 14*a* to thereby fix the carrier 16*a*, and the shower arc 12*a*, at the desired height. Located proximate the bottom of each of the side plates 70*a* and 72*a* is a hole 84*a* for receiving a respective one of a pair of pivot shafts or pins 86*a*. Only one of the pivot shafts 86*a* is shown, because each pivot shaft 86*a* is identical to the other. Carrier 16*a* differs from the carrier 16 in that the U-shaped cutout 82, the U-shaped cutout 114, and the elongated oval hole 116 have been eliminated from the carrier 16*a* thus simplifying the manufacture of the carrier 16*a*. In addition, the plates 70*a*, 72*a*, and 74*a* are simple rectangular plates which helps to further simplify the manufacture of the carrier 16*a*.

The shower arc 12*a* differs from the shower arc 12 in that the inlet pipe 98 is removed from the middle of the pipe 88. The inlet pipe 98 is replaced by an elbow 98*a* which is attached to the pipe 88 at a location on either side of the middle portion of the pipe 88 which is delineated by the pivot plates 102*a* and 104*a*. The elbow 98*a* projects perpendicularly above the plane defined by the circular arc of the pipe 88. The elbow 98*a* forms the inlet to the arcuate pipe 88, the bore of the pipe elbow 98*a* being in fluid communication with the arcuate pipe 88. The pipe elbow 98*a* is adapted for the attachment of the hose 18 and allows for fluid communication between the hose 18 and the pipe 88.

A pair of pivot plates 102*a* and 104*a* are attached to the arcuate pipe 88 on either side of the middle portion of the arcuate pipe 88. The pivot plates 102*a* and 104*a* extend in parallel to one another away from the center of curvature of the arcuate pipe 88. The pivot plates 102*a* and 104*a* are spaced apart such that the carrier 16*a* fits snugly between the pivot plates 102*a* and 104*a*, with the side walls 70*a* and 72*a* parallel to the pivot plates 102*a* and 104*a*. Each of the pivot plates 102*a* and 104*a* has a hole for a respective pivot pin 86*a* to extend through the pivot plate. With the pivot plates 102*a* and 104*a* positioned on either side of the carrier 16*a*, each of the pivot shafts 86*a* is positioned to extend through a respective hole 84*a* and through the hole in the respective one of the plates 102*a* and 104*a* to pivotally attach the shower arc 12*a* to the carrier 16*a*. The pivot shafts 86*a* can be of any well known type. There should be sufficient frictional force between the pivot plate 102*a* and the side plate 72*a* and between the pivot plate 104*a* and the side plate

70*a* so that the shower arc 12*a* will stay up after it has been folded up into the retracted or storage position. The pivot plates 102*a* and 104*a* are also provided with projections or stop pins 110 and 112 to prevent the shower arc 12*a* from pivoting downward past the horizontal position. The pivot plates 102*a* and 104*a* are essentially similar to the pivot plates 102 and 104, except that the pivot plates 102*a* and 104*a* are shaped differently due to their closer proximity to the knob 80*a*.

Referring to FIGS. 20, 21, 22A, and 22B, alternative embodiments 14*b* and 14*c* of the guide plate 14 can be seen. The guide plate 14*b* is essentially the same as the guide plate 14*a*, while the guide plate 14*c* is essentially the same as the guide plate 14. The only major difference between the guide plate 14*b* and the guide plate 14*a* is that the grooves 38*a* and 40*a*, on either side of the guide plate 14*b*, are slightly modified as compared to grooves 38 and 40. In the case of the grooves 38*a* and 40*a*, the walls 128 and 130 of the grooves 38*a* and 40*a*, respectively, laterally extend for a greater distance as compared to the walls 132 and 134 of the grooves 38*a* and 40*a*. The walls 128 and 130 of the grooves 38*a* and 40*a* are positioned adjacent the shower wall 22 when the guide plate 14*b* is installed in a shower. This feature allows the grooves 38*a* and 40*a* to better support the rib 66 or 66*a* and the rib 68 or 68*a*, respectively. Similarly, the only major difference between the guide plate 14*c* and the guide plate 14 is that the grooves 38*a* and 40*a*, on either side of the guide plate 14*c*, are slightly modified as compared to grooves 38 and 40. The grooves 38*a* and 40*a* of the guide plate 14*c* are modified in exactly the same manner as has already been described with reference to the grooves 38*a* and 40*a* of the guide plate 14*b*. Also, the embodiment 14*c* of the guide plate illustrates a circular hole 36*a*, designed to allow the shower head supply pipe 20 to extend through the guide plate, which can be used as an alternative to the oval opening 36 of the guide plate 14. In addition, the embodiments 14*b* and 14*c* of the guide plate illustrate alternative forms 50*a* and 52*a* for the stops 50 and 52 formed at the bottom ends of the grooves 38 and 40.

The arcuate pipe 88 extends along the circumference of the imaginary circle defining the circular arc followed by the arcuate pipe 88, for a distance in the range of about one half to about seven eighths of the circumference of the imaginary circle. In one embodiment, the arcuate pipe extends for about three quarters of the circumference of the circle defining the circular arc followed by the arcuate pipe 88.

The holes 84 or 84*a* should be positioned at a sufficient perpendicular distance above the plane containing the circular arc followed by the arcuate pipe 88, when the arcuate pipe 88 is in the horizontal position, such that the arcuate pipe 88 can be pivotally moved to the vertical or storage position without the carrier 16 or 16*a* interfering with the pivotal movement of the arcuate pipe 88 to the vertical position.

It is to be understood that the present invention is not limited to the sole embodiments described above, but encompasses any and all embodiments within the scope of the following claims.

I claim:

1. A shower appliance comprising:

a guide plate adapted for being fixedly positioned relative to a shower wall;

a carrier slidably mounted on said guide plate and being adapted to move slidably along said guide plate, said carrier also forming a clamping means which allows said carrier to be fixedly positioned at a user selected location along said guide plate;

a perforated, arcuate pipe pivotally attached to said carrier;

a pipe inlet communicating with said arcuate pipe; and a hose having a first and a second end, said first end of said hose being coupled to said pipe inlet, and said second end of said hose being adapted for coupling to a liquid source; wherein said guide plate has a first and a second groove on either side thereof, said carrier has a front plate, a first side plate, and a second side plate, said first side plate and said second side plate being perpendicular to and extending from either side of said front plate, said first side plate and said second side plate being parallel to one another, said first side plate and said second side plate each having an edge distal from said front plate, said first side plate having a first rib adapted for engagement with said first groove in said guide plate, and said second side plate having a second rib adapted for engagement with said second groove of said guide plate, said carrier further including a screw having a threaded shaft and a grasping knob, one of said first and second side plates having a clamp screw opening while another one of said first and second side plates has a threaded bore in fixed relationship thereto, said threaded shaft passing through said clamp screw opening and matingly engaging said threaded bore, whereby tightening said screw forces said first and second side plates toward one another to thereby clamp said carrier to said guide plate and releasably fix said carrier at a user selected location along said guide plate.

2. The shower appliance according to claim 1, wherein said guide plate is substantially in the shape of an elongated rectangle in plan view and has a front face and a back face, said guide plate has a length and a thickness extending perpendicularly between said front face and said back face, said back face being in contact with the shower wall when said guide plate is installed in a shower, said first and second grooves are located intermediate said front face and said back face on either side of said guide plate, each of said first and second grooves extends for substantially the length of said guide plate, each of said first and second grooves is defined by a bottom and first and second sidewalls which are parallel to said front face and said back face with said first sidewall of each of said first and second grooves being proximate said back face and said second sidewall of each of said first and second grooves being proximate said front face.

3. The shower appliance according to claim 2, wherein each of said first and second grooves has a top end and a bottom end and each of said first and second grooves has an obstruction near the bottom end thereof which acts as a stop for preventing said carrier from sliding off of said guide plate.

4. The shower appliance according to claim 3, wherein said guide plate has a top end and a first opening near said top end of said guide plate, and said first opening is adapted for allowing the passage of a fluid supply pipe through said guide plate when said guide plate is installed in a shower.

5. The shower appliance according to claim 4, further including a retaining plate comprising:

a plate portion having a second opening at least large enough to allow passage of the fluid supply pipe through said plate portion;

a collar having a bore which is in registry with said second opening, said collar projecting from one side of said plate portion, said collar having a threaded hole transverse to said bore; and a screw engaged to said threaded hole, whereby said screw can be tightened to frictionally engage the fluid supply pipe when said guide plate and said retaining plate are positioned such that the fluid supply pipe extends through said first opening, said second opening, and said bore of said collar, to thereby retain said guide plate in abutting contact against the shower wall.

6. The shower appliance according to claim 1, wherein said arcuate pipe has a middle and said pipe inlet is in the form of a pipe provided at about said middle of said arcuate pipe and communicating with said arcuate pipe.

7. The shower appliance according to claim 6, wherein said arcuate pipe substantially follows a circular arc defined by a circle having a circumference.

8. The shower appliance according to claim 7, wherein said arcuate pipe has a first set and a second set of perforations, said first set of perforations is oriented to discharge a fluid supplied to said arcuate pipe substantially horizontally and toward the center of curvature of the arcuate pipe when said arcuate pipe is pivotally moved such that the circular arc followed by said arcuate pipe lies substantially in a horizontal plane, and said second set of perforations is oriented so as to discharge a fluid supplied to said arcuate pipe downward at about a 45° angle relative to the horizontal and toward a vertical line passing through the center of curvature of the arcuate pipe when said arcuate pipe is pivotally moved such that the circular arc followed by said arcuate pipe lies substantially in a horizontal plane.

9. The shower appliance according to claim 8, wherein said arcuate pipe extends along the circumference of the circle defining the circular arc followed by said arcuate pipe for a distance in the range of about one half to about seven eighths of the circumference of the circle defining the circular arc followed by said arcuate pipe.

10. The shower appliance according to claim 9, wherein said arcuate pipe extends along the circumference of the circle defining the circular arc followed by said arcuate pipe for a distance of about three quarters of the circumference of the circle defining the circular arc followed by said arcuate pipe.

11. The shower appliance according to claim 10, wherein first side plate has a first hole and said second side plate has a second hole, the shower appliance further comprising:

a pair of pivot plates extending in parallel from said arcuate pipe with said pair of pivot plates being symmetrically positioned on either side of the middle of said arcuate pipe, said pair of pivot plates being spaced apart such that said carrier can fit therebetween with a first one of said pair pivot plates being positioned proximate said first side plate and a second one of said pair of pivot plates being positioned proximate said second side plate, said first one of said pair of pivot plates having a third hole and said second one of said pair of pivot plates having a fourth hole; and a pair of pivot pins each being positioned to extend through a respective one of said first and second holes and a respective one of said third and fourth holes to thereby pivotally attach said arcuate pipe to said carrier.

12. The shower appliance according to claim 11, wherein said third and fourth holes are positioned vertically at a sufficient height above a plane containing the circular arc followed by said arcuate pipe when said arcuate pipe is positioned such that the plane containing the circular arc followed by said arcuate pipe is substantially horizontal, whereby said arcuate pipe can be pivotally moved such that the circular arc followed by said arcuate pipe lies substantially in a vertical plane without said carrier interfering with movement of said arcuate pipe.

13. The shower appliance according to claim 1, wherein said arcuate pipe has a middle portion and said pipe inlet is in the form of a pipe elbow provided to one side of said middle portion of said arcuate pipe such that said arcuate pipe can pivotally move between a horizontal position and a vertical position without said carrier interfering with said pipe elbow, and said pipe elbow communicates with said arcuate pipe.

14. The shower appliance according to claim 13, wherein said arcuate pipe substantially follows a circular arc defined by a circle having a circumference.

15. The shower appliance according to claim 14, wherein said arcuate pipe has a first set and a second set of perforations, each of said first set of perforations is oriented to discharge a fluid supplied to said arcuate pipe substantially horizontally and toward the center of curvature of the arcuate pipe when said arcuate pipe is pivotally moved such that the circular arc followed by said arcuate pipe lies substantially in a horizontal plane, and each of said second set of perforations is oriented so as to discharge a fluid supplied to said arcuate pipe downward at about a 45° angle relative to the horizontal and toward a vertical line passing through the center of curvature of said arcuate pipe when said arcuate pipe is pivotally moved such that the circular arc followed by said arcuate pipe lies substantially in a horizontal plane.

16. The shower appliance according to claim 15, wherein said arcuate pipe extends along the circumference of the circle defining the circular arc followed by said arcuate pipe for a distance in the range of about one-half to about seven-eighths of the circumference of the circle defining the circular arc followed by said arcuate pipe.

17. The shower appliance according to claim 16, wherein said arcuate pipe extends along the circumference of the circle defining the circular arc followed by said arcuate pipe for a distance of about three-quarters of the circumference of the circle defining the circular arc followed by said arcuate pipe.

18. The shower appliance according to claim 17, wherein first side plate has a first hole and said second side plate has a second hole, said arcuate pipe has a middle, the shower appliance further comprising:

a pair of pivot plates extending in parallel from said arcuate pipe with said pair of pivot plates being symmetrically positioned on either side of the middle of said arcuate pipe, said pair of pivot plates being spaced apart such that said carrier can fit therebetween with a first one of said pair pivot plates being positioned proximate said first side plate and a second one of said pair of pivot plates being positioned proximate said second side plate, said first one of said pair of pivot plates having a third hole and said second one of said pair of pivot plates having a fourth hole; and a pair of pivot pins each being positioned to extend through a respective one of said first and second holes and a respective one of said third and fourth holes to thereby pivotally attach said arcuate pipe to said carrier.

19. The shower appliance according to claim 18, wherein said third and fourth holes are positioned vertically at a sufficient height above a plane containing the circular arc followed by said arcuate pipe when said arcuate pipe is positioned such that the plane containing the circular arc followed by said arcuate pipe is substantially horizontal, whereby said arcuate pipe can be pivotally moved such that the circular arc followed by said arcuate pipe lies substantially in a vertical plane without said carrier interfering with movement of said arcuate pipe.

* * * * *